US009798288B2

(12) United States Patent
Maehata et al.

(10) Patent No.: US 9,798,288 B2
(45) Date of Patent: Oct. 24, 2017

(54) IMAGE FORMING APPARATUS WHICH CONTROLS THE ROTATION SPEED OF A LUBRICANT SUPPLY ROLLER

(71) Applicants: Yasuhiro Maehata, Tokyo (JP); Kenji Honjoh, Kanagawa (JP); Takeshi Shintani, Kanagawa (JP); Nobuo Kuwabara, Kanagawa (JP); Daisuke Tomita, Kanagawa (JP); Yasuhito Kuboshima, Tokyo (JP); Yusuke Ishizuka, Kanagawa (JP)

(72) Inventors: Yasuhiro Maehata, Tokyo (JP); Kenji Honjoh, Kanagawa (JP); Takeshi Shintani, Kanagawa (JP); Nobuo Kuwabara, Kanagawa (JP); Daisuke Tomita, Kanagawa (JP); Yasuhito Kuboshima, Tokyo (JP); Yusuke Ishizuka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/145,228

(22) Filed: May 3, 2016

(65) Prior Publication Data

US 2016/0334757 A1 Nov. 17, 2016

(30) Foreign Application Priority Data

May 15, 2015 (JP) ..... 2015-100208
Oct. 20, 2015 (JP) ..... 2015-205998
Feb. 22, 2016 (JP) ..... 2016-030769

(51) Int. Cl.
*G03G 21/00* (2006.01)
*G03G 21/20* (2006.01)

(52) U.S. Cl.
CPC ..... *G03G 21/203* (2013.01); *G03G 21/0094* (2013.01)

(58) Field of Classification Search
CPC ..... G03G 21/0011; G03G 21/0094; G03G 21/203
USPC ..... 399/346
See application file for complete search history.

(56) References Cited

U.S. PATENT DOCUMENTS

2010/0183349 A1 7/2010 Shintani et al.
2012/0315053 A1 12/2012 Kudo et al.
2012/0321330 A1 12/2012 Kudo et al.
2013/0251381 A1 9/2013 Seki et al.
2013/0251382 A1 9/2013 Honjoh et al.
2015/0160600 A1* 6/2015 Saito ..... G03G 21/0094 399/346

FOREIGN PATENT DOCUMENTS

JP 2011-242467 12/2011

* cited by examiner

*Primary Examiner* — Hoang Ngo
(74) *Attorney, Agent, or Firm* — Oblon, McClelland, Maier & Neustadt, L.L.P.

(57) ABSTRACT

An image forming apparatus includes an image bearer to bear a toner image, a lubricant supply roller to supply lubricant to a surface of the image bearer, a rotation speed changer to change a rotation speed of the lubricant supply roller, and a controller to control the rotation speed changer to change the rotation speed of the lubricant supply roller to a target speed based on a predetermined condition. The controller is configured to control the rotation speed changer to avoid a predetermined speed range.

19 Claims, 10 Drawing Sheets

IMAGE FORMING APPARATUS WHICH CONTROLS THE ROTATION SPEED OF A LUBRICANT SUPPLY ROLLER

CROSS-REFERENCE TO RELATED APPLICATIONS

This patent application is based on and claims priority pursuant to 35 U.S.C. §119(a) to Japanese Patent Application Nos. 2015-100208 filed on May 15, 2015, 2015-205998 filed on Oct. 20, 2015, and 2016-030769 filed on Feb. 22, 2016 in the Japan Patent Office, the entire disclosure of each of which is hereby incorporated by reference herein.

BACKGROUND

Technical Field

Embodiments of the present invention generally relate to an electrophotographic image forming apparatus such as a photocopier, a facsimile machine, a printer, or a multifunction peripheral (MFP) having at least two of copying, printing, facsimile transmission, plotting, and scanning capabilities.

Description of the Related Art

Typically, image forming apparatuses, such as copiers and printers, include a lubricant supply device employing a lubricant supply roller to slide on a surface of an image bearer, such as a photoconductor drum or an intermediate transfer belt, to lubricate the surface of the image bearer. There are image forming apparatuses in which the rotation speed (e.g. revolutions per minute or RPM) of the lubricant supply roller is changed to reliably supply a constant amount of lubricant to the image bearer based on predetermined conditions.

For example, in addition to the lubricant supply roller to slide on the image bearer, the lubricant supply device includes a solid lubricant that abuts on the lubricant supply roller, a biasing member to bias the solid lubricant to the lubricant supply roller, and the like. While rotating in a predetermined direction, the lubricant supply roller scrapes off lubricant from the solid lubricant and supplies the lubricant to the surface of the photoconductor drum.

SUMMARY

An embodiment of the present invention provides an image forming apparatus that includes an image bearer to bear a toner image, a lubricant supply roller to supply lubricant to a surface of the image bearer, a rotation speed changer to change a rotation speed of the lubricant supply roller, and a controller to control the rotation speed changer to change the rotation speed of the lubricant supply roller to a target speed based on a predetermined condition. The controller controls the rotation speed changer to avoid a predetermined speed range.

In another embodiment, an image forming apparatus includes the image bearer, the lubricant supply roller, and the rotation speed changer described above. The image forming apparatus further includes a train of gears to transmit a driving force to the lubricant supply roller, a gear combination changer to switch the train of gears from a reference combination to an alternative combination to change an eigenfrequency in driving the lubricant supply roller, and a controller to cause the rotation speed changer to change the rotation speed of the lubricant supply roller to a target speed based on a predetermined condition. The controller is configured to cause the gear combination changer to switch the reference combination to the alternative combination in a case where the train of gears is in the reference combination and the target speed of the lubricant supply roller is consistent with at least one predetermined speed to be avoided.

In yet another embodiment, an image forming apparatus includes the image bearer, the lubricant supply roller, and the rotation speed changer described above. The image forming apparatus further includes a controller to control the rotation speed changer to regularly change the rotation speed of the lubricant supply roller to a target speed based on a predetermined condition. The controller is configured to irregularly change the target speed of the lubricant supply roller in a predetermined range.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
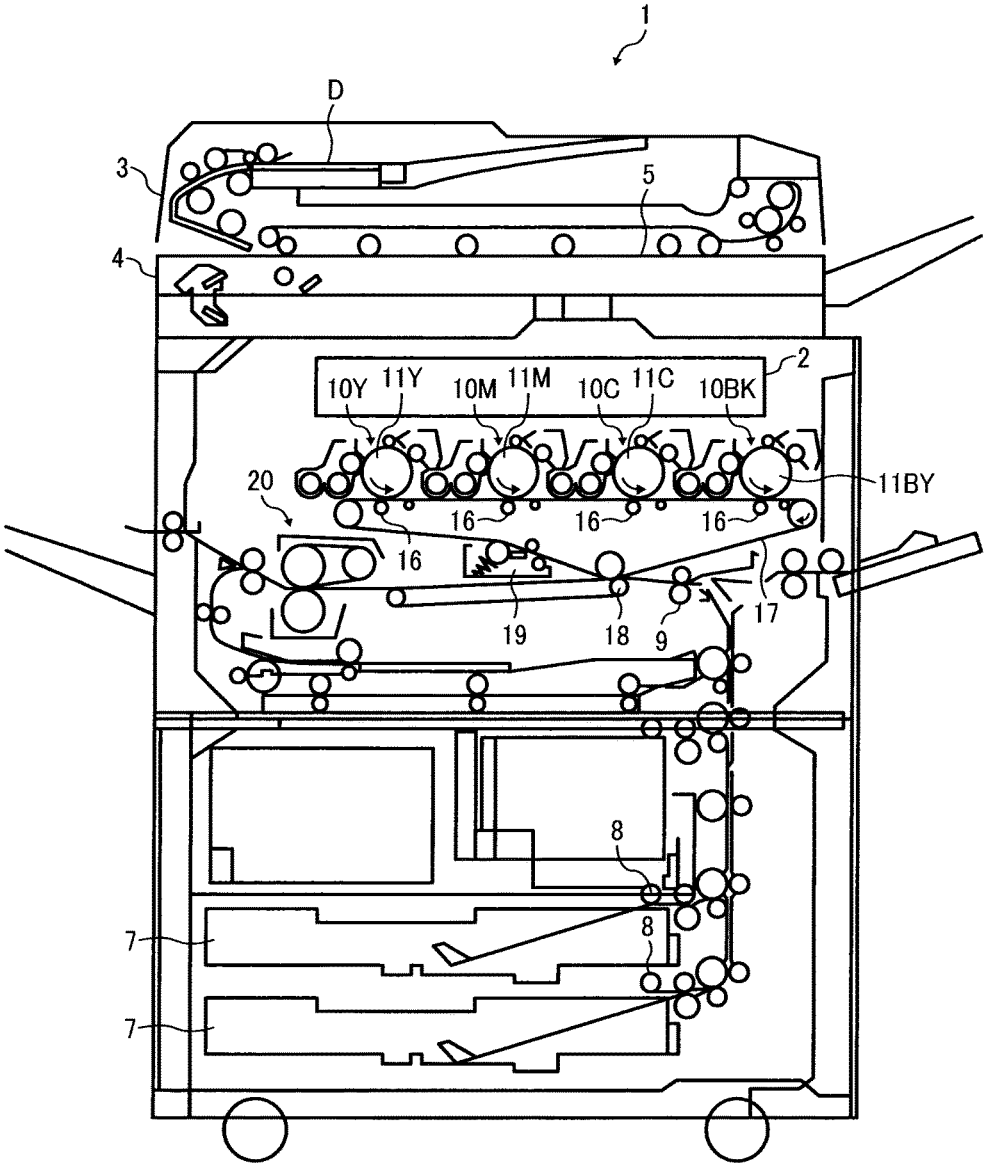
FIG. 1 is a schematic diagram illustrating a configuration of an image forming apparatus according to Embodiment 1.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and BK attached to each reference numeral indicate only that components indicated thereby are used for forming yellow, magenta, cyan, and black images, respectively, and hereinafter may be omitted when color discrimination is not necessary.

First Embodiment

Embodiment 1 is described with reference to FIGS. 1 to 5.

Figure 2:
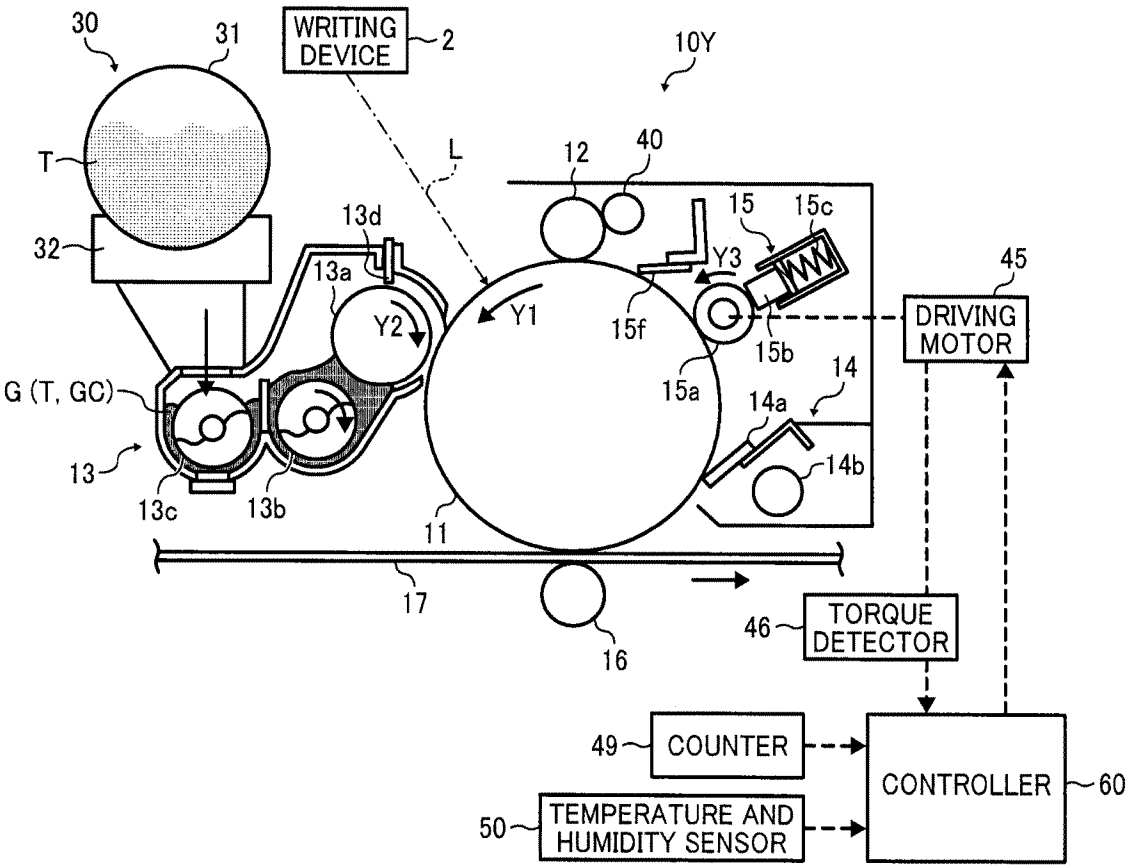
FIG. 2 is a cross-sectional view of a process cartridge and a vicinity thereof in the image forming apparatus illustrated in FIG. 1.

Referring to FIGS. 1 and 2, a configuration and operation of an image forming apparatus according to the present embodiment is described below.

FIG. 1 is a schematic diagram illustrating a configuration of an image forming apparatus according to Embodiment 1. FIG. 2 is a cross-sectional view of one of process cartridges 10Y, 10M, 10C, and 10BK (i.e., an image forming unit), namely, the process cartridge 10Y for yellow, incorporated in the image forming apparatus 1 illustrated in FIG. 1.

It is to be noted that the process cartridges 10Y, 10M, 10C, and 10BK have a similar configuration except the color of toner used in image formation, and thus the process cartridge 10Y is illustrated as a representative.

In FIG. 1, reference number 1 represents the image forming apparatus, which in the present embodiment is a tandem-type multicolor copier, 2 represents a writing device to emit laser beams according to image data, 3 represents a document feeder to send a document D to a document reading unit 4 that reads image data of the document D, 7 represents a sheet feeding tray containing sheets of recording media (i.e., transfer paper, 8 represents feed rollers, 9 represents a registration roller pair to adjust the timing to transport the sheet, 10Y, 10M, 10C, and 10BK represent the process cartridges to form yellow, magenta, cyan, and black toner images, respectively, 16 represents primary-transfer bias rollers to transfer the toner images from the respective photoconductor drums 11 onto an intermediate transfer belt 17, 18 represents a secondary-transfer bias roller to transfer a toner image from the intermediate transfer belt 17 onto the sheet, 19 represents a belt cleaning device to clean the intermediate transfer belt 17, and 20 represents a fixing device to fix the toner image on the sheet of recording media.

Operations of the image forming apparatus 1 illustrated in FIG. 1 to form multicolor images are described below.

In the document feeder 3, conveyance rollers transport documents D set on a document table in a direction indicated by an arrow onto an exposure glass 5 of the document reading unit 4. Then, the document reading unit 4 reads image data of the document D set on the exposure glass 5 optically.

More specifically, the document reading unit 4 scans the image on the document D with light emitted from an illumination lamp. The light reflected by a surface of the document is imaged on a color sensor via mirrors and lenses. The color sensor reads the multicolor image data of the document D for each of decomposed colors of red, green, and blue (RGB) and convert the image data into electrical image signals. Further, an image processor performs image processing (e.g., color conversion, color calibration, and spatial frequency adjustment) according to the image signals, and thus image data of yellow, magenta, cyan, and black are obtained.

Then, the yellow, magenta, cyan, and black image data is transmitted to the writing device 2 (i.e., an exposure device). Then, the writing device 2 directs laser beams L to the respective photoconductor drums 11 of the process cartridges 10Y, 10M, 10C, and 10BK according to the yellow, magenta, cyan, and black image data.

Meanwhile, the photoconductor drums 11 in the four process cartridges 10Y, 10M, 10C, and 10BK rotate in a predetermined direction (counterclockwise in FIG. 1). Initially, the surface of the photoconductor drum 11 is charged by the charging roller 12 uniformly at a position facing the charging roller 12 (charging process). Thus, the surface of the photoconductor drum 11 is charged to a predetermined electrical potential. Subsequently, the charged surface of the photoconductor drum 11 reaches a position to receive the laser beam L.

The writing device 2 emits the laser beams L according to image data from four light sources. The four laser beams L pass through different optical paths for yellow, magenta, cyan, and black (exposure process).

The laser beam L corresponding to the yellow component is directed to the photoconductor drum 11Y, which is the first from the left in FIG. 1 among the four photoconductor drums 11. A polygon mirror that rotates at high speed deflects the laser beam L for yellow in a direction of a rotation axis of the photoconductor drum 11Y (main scanning direction) so that the laser beam L scans the surface of the photoconductor drum 11Y. Thus, an electrostatic latent image for yellow is formed on the photoconductor drum 11Y charged by the charging roller 12.

Similarly, the laser beam L corresponding to the magenta component is directed to the surface of the photoconductor drum 11M, which is the second from the left in FIG. 1, thus forming an electrostatic latent image for magenta thereon. The laser beam L corresponding to the cyan component is directed to the surface of the photoconductor drum 11C, which is the third from the left in FIG. 1, thus forming an electrostatic latent image for cyan thereon. The laser beam L corresponding to the black component is directed to the surface of the photoconductor drum 11BK, which is the fourth from the left in FIG. 1, thus forming an electrostatic latent image for black thereon.

Subsequently, the surface of the photoconductor drum 11 where the electrostatic latent image is formed is further transported to the position facing the developing device 13. Each developing device 13 supplies toner of the corresponding color to the photoconductor drum 11 to develop the latent image on the photoconductor drum 11 into a single-color toner image (development process).

Subsequently, the surface of the photoconductor drum 11 reaches a position facing the intermediate transfer belt 17, serving as the image bearer as well as an intermediate transferor. The intermediate transferor is not limited to a belt but can be a drum. The primary-transfer bias rollers 16 are disposed at the positions where the respective photoconductor drums 11 face the intermediate transfer belt 17 and in contact with an inner face of the intermediate transfer belt 17. At these positions, the toner images on the respective photoconductor drums 11 are sequentially transferred and superimposed one on another on the intermediate transfer belt 17, into a multicolor toner image thereon (primary transfer process).

Subsequently, the surface of each photoconductor drum 11 reaches a position facing the cleaning device 14 (i.e., a cleaning section), where a cleaning blade 14*a* mechanically removes toner (i.e., untransferred toner) remaining on the photoconductor drum 11, and the removed toner is collected in the cleaning device 14 (cleaning process). A conveying screw 14*b* transports the untransferred toner collected in the cleaning device 14 outside the cleaning device 14, and the untransferred toner is collected, as waste toner, in a waste toner container.

Subsequently, the surface of each photoconductor drum 11 passes through a lubricant supply device 15 and a discharge device sequentially. Then, a sequence of image forming processes performed on each photoconductor drum 11 is completed.

Meanwhile, the surface of the intermediate transfer belt 17 carrying the superimposed toner image moves clockwise in the drawing and reaches the position facing the secondary-transfer bias roller 18. The secondary-transfer bias roller 18 transfers the multicolor toner image from the intermediate transfer belt 17 onto the sheet (secondary transfer process).

Further, the surface of the intermediate transfer belt 17 reaches a position facing the belt cleaning device 19. The belt cleaning device 19 collects untransferred toner remaining on the intermediate transfer belt 17. Thus, a sequence of transfer processes performed on the intermediate transfer belt 17 is completed.

The sheet is transported from one of the sheet feeding trays 7 via the registration roller pair 9, and the like, to the secondary transfer nip between the intermediate transfer belt 17 and the secondary-transfer bias roller 18.

More specifically, a sheet feeding roller 8 sends out the sheet from the sheet feeding tray 7, and the sheet is then guided by a sheet guide to the registration roller pair 9 (i.e., timing roller pair). The registration roller pair 9 forwards the sheet to the secondary transfer nip, timed to coincide with the arrival of the multicolor toner image formed on the intermediate transfer belt 17.

Then, the sheet carrying the multicolor image is transported to the fixing device 20. The fixing device 20 includes a fixing belt and a pressure roller pressing against each other. In a nip therebetween, the multicolor image (toner image) is fixed on the sheet.

After the fixing process, discharge rollers, discharge the sheet as an output image outside the image forming apparatus 1. Thus, a sequence of image forming processes is completed.

It is to be noted that, in Embodiment 1, the image forming apparatus 1 has a low-speed mode in which image formation is performed with a slowed process linear speed (speed at which sheets are fed and a linear speed of image forming components such as the photoconductor drums 11). The image forming apparatus 1 enters the low-speed mode to form images on thick sheets or to secure high quality of fixed images. Via a control panel, users can switch a standard mode to form images with a standard process linear speed to the low-speed mode in which the process linear speed is reduced.

Referring to FIG. 2, the process cartridge 10Y is described in further detail below.

As illustrated in FIG. 2, in the process cartridge 10Y, the photoconductor drum 11 serving as an image bearer, the charging roller 12 serving as a charging device, the developing device 13, the cleaning device 14, and the lubricant supply device 15 are united together. The process cartridge 10Y is removably mounted in the body of the image forming apparatus 1 (hereinafter "apparatus body") and removed from the apparatus body as required for replacement or repair, for example.

The photoconductor drum 11 used in the present embodiment is an organic photoconductor charged to a negative polarity and includes a photosensitive layer on a drum-shaped conductive support body.

For example, the photoconductor drum 11 is multilayered and includes a base coat serving as an insulation layer, the photosensitive layer, and a protection layer (surface layer) sequentially overlying the support body. The photosensitive layer includes a charge generation layer and a charge transport layer.

The photoconductor drum 11 is rotated, by a driving motor (a main motor), counterclockwise in FIG. 2 as indicated by arrow Y1 illustrated in FIG. 2.

Referring to FIG. 2, the charging roller 12 is a charging roller including a conductive metal core and an elastic layer of moderate resistivity overlying an outer circumference of the metal core. Receiving a predetermined voltage, which includes a direct-current (DC) voltage and an alternating-current (AC) voltage superimposed on the DC voltage, from a power source, the charging roller 12 uniformly charges the surface of the photoconductor drum 11 facing the charging roller 12.

Although a compression spring presses the charging roller 12 against the photoconductor drum 11 in Embodiment 1, in another embodiment, the charging roller 12 disposed across a minute gap from the photoconductor drum 11. Additionally, although the AC voltage is superimposed on the DC voltage in the charging bias in Embodiment 1, in another embodiment, the charging bias includes a DC voltage only.

In Embodiment 1, a cleaning roller 40 is pressed to the charging roller 12 to clean the surface of the charging roller 12.

The developing device 13 includes a developing roller 13*a* disposed facing the photoconductor drum 11, a first conveying screw 13*b* disposed facing the developing roller 13*a*, a second conveying screw 13*c* disposed facing the first conveying screw 13*b* via a partition, and a doctor blade 13*d* disposed facing the developing roller 13*a*. The developing roller 13*a* includes a magnet roller or multiple magnets and a sleeve that rotates around the magnets. The magnets are stationary and generate magnetic poles around the circumference of the developing roller 13*a*. Developer G is borne on the developing roller 13*a* by the multiple magnetic poles generated on the sleeve.

The developing device 13 contains two-component developer G including carrier GC (carrier particles) and toner T (toner particles).

The cleaning device 14 includes a cleaning blade 14*a* disposed in contact with the photoconductor drum 11 to clean the surface of the photoconductor drum 11 and further includes the conveying screw 14*b* to transport the toner collected in the cleaning device 14. The conveying screw 14*b* transports the collected toner in a width direction, which is perpendicular to the surface of the paper on which FIG. 2 is drawn.

The cleaning blade 14*a* is made of, for example, rubber such as urethane rubber, and contacts or abuts the surface of the photoconductor drum 11 at a predetermined angle, with a predetermined pressure. With this configuration, substances such as untransferred toner adhering to the photoconductor drum 11 are mechanically scraped off and collected in the cleaning device 14. The substances adhering to the photoconductor drum 11 include paper dust arising from transfer sheets, discharge products arising on the photoconductor drum 11 during electrical discharge by the charging roller 12, and additives to toner. It is to be noted that, in Embodiment 1, the cleaning blade 14*a* contacts or abuts the photoconductor drum 11 in the direction counter to the direction of rotation of the photoconductor drum 11.

Referring to FIG. 2, the lubricant supply device 15 includes a solid lubricant 15*b*, a lubricant supply roller 15*a* (a lubrication rotator) to slidingly contact the solid lubricant 15*b* and supply lubricant to the photoconductor drum 11, a compression spring 15*c*, a lubricant holder (a support plate) to hold the solid lubricant 15*b*, and a leveling blade 15*f*. The lubricant supply roller 15*a* includes an elastic layer that slidingly contacts the photoconductor drum 11. The compression spring 15*c* serves as a biasing member to bias the solid lubricant 15*b* to the lubricant supply roller 15*a*. The leveling blade 15*f* contacts or abuts the photoconductor drum 11 to level the lubricant supplied to the photoconductor drum 11 into a thin layer.

The lubricant supply device 15 is disposed downstream from the cleaning device 14 (the cleaning blade 14*a* in particular) and upstream from the charging roller 12 in the direction of rotation of the photoconductor drum 11. The leveling blade 15*f* is disposed downstream from the lubricant supply roller 15*a* in the direction of rotation of the photoconductor drum 11.

The lubricant supply roller 15*a* is a roller including a metal shaft i.e., a metal core) and an elastic foam layer made of, for example, polyurethane foam (urethane foam) overlying the metal shaft. With the elastic foam layer in contact with the surface of the photoconductor drum 11, the lubricant supply roller 15*a* rotates counterclockwise in FIG. 2 (indicated by arrow Y3), driven by a driving motor 45. Specifically, a driving gear disposed on a motor shaft of the driving motor 45 meshes with a driven gear disposed on a rotation shaft of the lubricant supply roller 15*a*. Then, a rotation driving force is transmitted from the driving motor 45 to the lubricant supply roller 15*a*. With this structure, the lubricant is supplied from the solid lubricant 15*b* via the lubricant supply roller 15*a* to the photoconductor drum 11.

The driving motor 45 to rotate the lubricant supply roller 15*a* is independent from the motor to rotate the photoconductor drum 11 and the like. The driving motor 45 is a variable-speed motor to change the rotation speed (number of revolutions) of the lubricant supply roller 15*a* only. The driving motor 45 serves as a rotation speed changer to change the rotation speed of the lubricant supply roller 15*a*. Changing the rotation speed of the lubricant supply roller 15*a* with the driving motor 45 is described later with reference to FIG. 4.

For example, the lubricant supply roller 15*a* is manufactured as follows. A block of urethane foam to be used as the elastic foam layer is formed from raw material (urethane foam). Cut the block to a suitable shape, polish the surface of the block, inserting a core (made of metal) therein, and shape the urethane foam into a roller. While rotating the polyurethane foam roller, move a grinding blade on the polyurethane foam roller in a direction parallel to the axial direction of the roller so that the roller is ground to a predetermined sponge thickness (traverse grinding). To enhance adhesiveness of the metal core with the elastic foam layer, adhesive can be applied to the metal core preliminarily. Additionally, in traverse grinding, the speed at which the polyurethane foam roller is rotated or moved can be changed to produce irregular surface unevenness on the surface of the elastic foam layer.

It is to be noted that, the method of manufacturing the lubricant supply roller 15*a* is not limited to the method described above. For example, in another method, urethane foam as raw material is put in a mold containing a metal core and hardened.

The lubricant supply roller 15*a* is driven to rotate in the direction counter to the photoconductor drum 11 rotating counterclockwise in FIG. 2. That is, the lubricant supply roller 15*a* rotates counterclockwise in FIG. 2. In other words, at the position where the lubricant supply roller 15*a* slides on the photoconductor drum 11, the lubricant supply roller 15*a* rotates in the direction opposite to the direction of rotation of the photoconductor drum 11.

The lubricant supply roller 15*a* is disposed to slidingly contact both of the solid lubricant 15*b* and the photoconductor drum 11. The lubricant supply roller 15*a* scrapes lubricant by rotation from the solid lubricant 15*b* and applies the lubricant to the photoconductor drum 11.

On the back side of the solid lubricant 15*b* (the lubricant holder) opposite the lubricant supply roller 15*a*, the compression spring 15*c* is disposed to inhibit uneven contact between the lubricant supply roller 15*a* and the solid lubricant 15*b*. The compression spring 15*c* presses the solid lubricant 15*b* to the lubricant supply roller 15*a*.

The solid lubricant 15*b* is produced by mixing inorganic lubricant in fatty acid metal zinc. Of various types of fatty acid metal zinc, a fatty acid metal zinc including zinc stearate, at least, is preferable. It is also preferable that the inorganic lubricant include at least one of talc, mica, and boron nitride.

Zinc stearate is a typical lamellar crystal powder. Lamellar crystals have a layer structure including self-organization of an amphiphilic molecule, and the crystal is broken easily along junctures between layers and becomes slippery receiving shearing force. Accordingly, friction on the surface of the photoconductor drum 11 can be reduced. That is, the surface of the photoconductor drum 11 can be coated effectively with a small amount of lubricant by lamellar crystals that cover the surface of the photoconductor drum 11 uniformly upon shearing force. The surface of the photoconductor drum 11 can be coated relatively uniformly to protect the photoconductor drum 11 from electrical stress in the charging process.

Use of the inorganic lubricant having a planar structure, such as talc, mica, and boron nitride, is advantageous in inhibiting the toner and the lubricant from escaping from the cleaning device 14 (the cleaning blade 14*a*) and accordingly protecting the charging roller 12 from contamination.

Additionally, in Embodiment 1, to manufacture the solid lubricant 15*b*, powder (raw material) is melted, and put is a mold to be compressed. Then, the melted material solidifies and has a rectangular shape or a shape similar thereto. Such manufacturing method is advantageous in simplifying manufacturing equipment, thereby reducing component cost.

The leveling blade 15*f* is made of rubber, such as urethane rubber, and is disposed to contact the photoconductor drum 11 at a predetermined angle with a predetermined pressure. The leveling blade 15*f* is disposed downstream from the cleaning blade 14*a* in the direction of rotation of the photoconductor drum 11. The leveling blade 15*f* levels off the lubricant on the photoconductor drum 11, which is supplied by the lubricant supply roller 15*a*, to a suitable amount uniformly.

The lubricant supply roller 15*a* supplies powdered lubricant to the photoconductor drum 11 from the solid lubricant 15*b*. However, the lubricant in this state does not exhibit sufficient lubricity. The leveling blade 15*f* makes the powdered lubricant into a thin layer and distributes the lubricant uniformly on the photoconductor drum 11. Then, the lubricant coats the photoconductor drum 11 and can fully exhibit its lubricity.

It is to be noted that, in Embodiment 1, the leveling blade 15*f* contacts or abuts the photoconductor drum 11 in the direction trailing to the direction of rotation of the photoconductor drum 11.

Since the cleaning device 14 according to Embodiment 1 separate blades (the cleaning blade 14*a* and the leveling blade 151) for cleaning and lubrication, good cleaning performance and good lubrication performance are attained. Additionally, wear of the cleaning blade 14*a* and the leveling blade 15*f* are alleviated by lubricating the photoconductor drum 11.

The image forming processes are described in further detail below with reference to FIG. 2.

The developing roller 13*a* rotates in the direction indicated by arrow Y2 illustrated in FIG. 2. In the developing device 13, as the first and second conveying screws 13*b* and 13*c*, arranged via the partition, rotate, the developer G is circulated in the longitudinal direction of the developing device 13, being stirred with fresh toner supplied from a toner supply section 30. The longitudinal direction of the developing device 13 is perpendicular to the surface of the paper on which FIG. 2 is drawn.

The toner T is electrically charged through friction with the carrier GC and attracted to the carrier GC. The toner is carried on the developing roller 13*a* together with the carrier GC. The developer G carried on the developing roller 13*a* reaches the doctor blade 13*d*. The amount of the developer G on the developing roller 13*a* is adjusted to a suitable amount by the doctor blade 13*d*, after which the developer G is carried to the developing range facing the photoconductor drum 11.

In the developing range, the toner T in the developer G adheres to the electrostatic latent image on the photoconductor drum 11. More specifically, the electrical potential in an image area, to which the laser beam L is directed to form the latent image (exposure potential), is different from that of the developing bias applied to the developing roller 13*a* (developing potential). The difference in electrical potential generates an electrical field, with which the toner T is attracted to the latent image.

Subsequently, most of the toner T adhering to the photoconductor drum 11 in the developing process is transferred to the intermediate transfer belt 17, and the untransferred toner remaining on the surface of the photoconductor drum 11 is collected in the cleaning device 14 by the cleaning blade 14*a*. Subsequently, the surface of each photoconductor drum 11 passes through the lubricant supply device 15 and the discharge device sequentially. Then, a sequence of image forming processes completes.

The toner supply section 30 of the apparatus body includes the replaceable toner bottles 31 and a toner hopper 32. The toner hopper 32 holds and drives the toner bottles 31, and supplies fresh toner to the developing devices 13. Each toner bottle 31 contains fresh toner T (yellow toner in FIG. 2). Additionally, a spiral-shaped protrusion is disposed on an inner face of the toner bottle 31.

The fresh toner T contained in the toner bottle 31 is supplied through a toner supply inlet to the developing device 13 as the toner T in the developing device 13 is consumed. The consumption of toner T in the developing device 13 is detected either directly or indirectly by a magnetic sensor disposed below the second conveying screw 13*c*.

Next, descriptions are given below of the configuration and operation of the image forming apparatus 1 (including the lubricant supply device 15 and the process cartridge 10) according to Embodiment 1.

As described above with reference to FIG. 2, the lubricant supply device 15 (the process cartridge 10) according to Embodiment 1 includes the lubricant supply roller 15*a*, which rotates in the predetermined direction (counterclockwise in FIG. 2) to supply the lubricant to the surface of the photoconductor drum 11. Additionally, to lubricate the photoconductor drum 11 without excess and deficiency even if the environment changes or components wears with time, the lubricant supply roller 15*a* is driven by the variable-speed driving motor 45 serving as the rotation speed changer. That is, controlled by a controller 60 (illustrated in FIG. 2) of the image forming apparatus 1, the driving motor 45 changes the rotation speed of the lubricant supply roller 15*a* based on predetermined conditions (e.g., total travel distance or total driving time of the lubricant supply roller 15*a*, environment condition, and the like), thereby inhibiting excess and deficiency of the amount of lubricant supplied to the photoconductor drum 11. However, when the rotation speed of the lubricant supply roller 15*a* is changed, an inconvenience can arise if the meshing frequency of a gear train to transmit driving force to the lubricant supply roller 15*a* matches an eigenfrequency of another component.

The controller 60 can be a computer including a central processing unit (CPU) and associated memory units (e.g., ROM, RAM, etc.). The computer performs various types of control processing by executing programs stored in the memory. Field programmable gate arrays (FPGA) may be used instead of CPUs.

Therefore, when a target speed, to which the driving motor 45 changes the rotation speed of the lubricant supply roller 15*a* based on the predetermined conditions, is consistent with a predetermined speed to be avoided (hereinafter "avoided speed X"), the controller 60 changes the target speed not to coincide with the avoided speed X. From a different view point, the driving motor 45 regularly changes the rotation speed of the lubricant supply roller 15*a* to the target speed based on the predetermined conditions, and, when the target speed of the lubricant supply roller 15*a* matches the avoided speed X, the controller 60 controls the driving motor 45 to irregularly change the rotation speed of the lubricant supply roller 15*a*.

Specifically, in a case where the rotation speed of the lubricant supply roller 15*a*, which is changed based on the predetermined criteria, coincides with the predetermined speed X (or one of multiple predetermined speeds), the driving motor 45 (the rotation speed changer) increases or decreases the rotation speed at a predetermined rate (e.g., a correction coefficient A) or by a predetermined value. That is, in a case where a target speed Ra (i.e., rotation frequency or number of revolutions), to which the rotation speed of the lubricant supply roller 15*a* is changed based on the predetermined conditions, is consistent with the avoided speed X (or one of multiple predetermined avoided speeds), the target speed Ra is increased or decreased at the predetermined rate (or by the predetermined value).

The avoided speed X is a rotation speed that makes the meshing frequency of a gear train to transmit the driving force from the driving motor 45 to the lubricant supply roller 15*a* to coincide with an eigenfrequency (resonance frequency) of another component such as the photoconductor drum 11, the charging roller 12, or the writing device 2. Such coincidence will induce resonance and is to be avoided. Generally, there are multiple rotation speeds to induce resonance (hereinafter "resonance-inducing rotation speeds") to be avoided. When the rotation speed of the lubricant supply roller 15*a* matches one of the resonance-inducing rotation speeds (i.e., the predetermined avoided speeds), resonance (vibration) occurs between the lubricant supply roller 15*a* and the component having the coinciding eigenfrequency. Accordingly, the photoconductor drum 11 vibrates greatly, causing inconveniences such as uneven image density of the toner image on the photoconductor drum 11.

Therefore, in another embodiment, multiple avoided speeds X are set, and the controller 60 is configured to control the driving motor 45 to increase or decrease the rotation speed of the lubricant supply roller 15*a* from the avoided speed in the case where the target speed Ra of the lubricant supply roller 15*a* is consistent with one of the multiple avoided speeds. For example, it is assumed that 130 revolutions per minute (rpm) and 140 rpm are set as the avoided speeds X. In a case where the target speed Ra is consistent with either 130 rpm or 140 rpm, the rotation speed of the lubricant supply roller 15*a* is increased or decreased (or example, changed to 135 rpm) not to coincide with 130 rpm or 140 rpm.

Figure 6A:
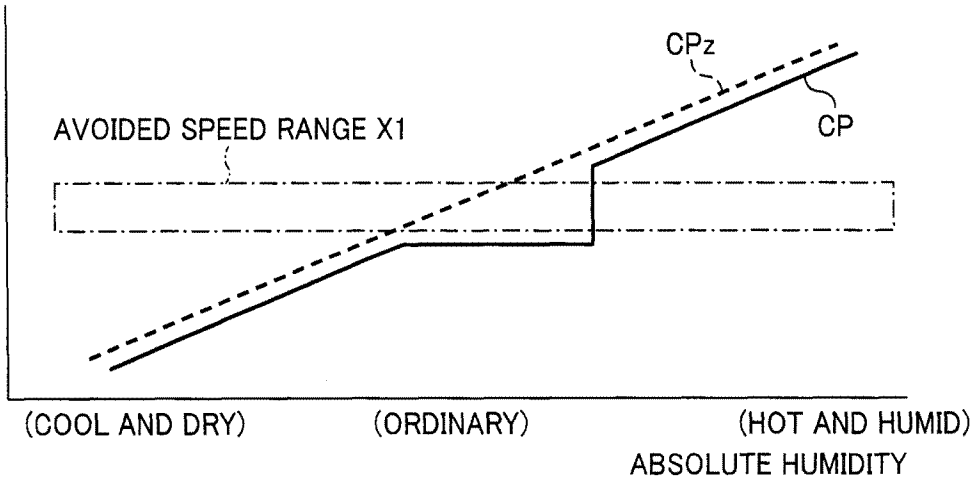
FIG. 6A is a graph illustrating a relation between absolute humidity and rotation speed of the lubricant supply roller in rotation speed control according to Embodiment 2.
Figure 6B:
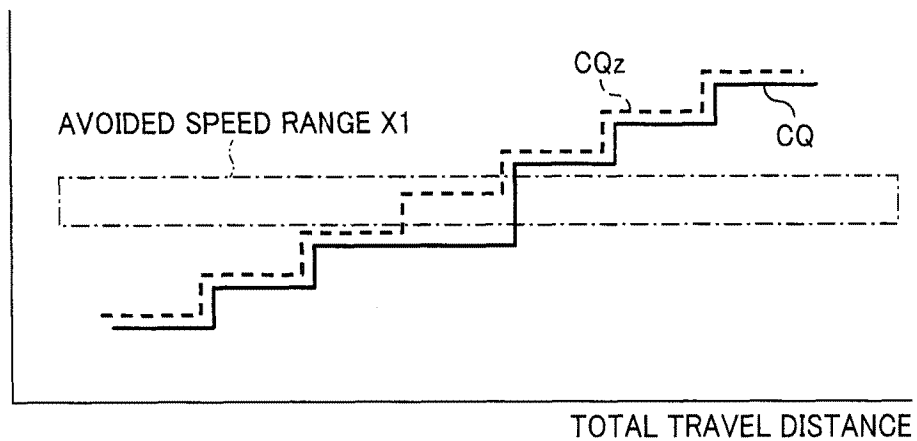
FIG. 6B is a graph illustrating a relation between total travel distance of the lubricant supply roller and the rotation speed thereof in the rotation speed control according to Embodiment 2.

In yet another embodiment, a predetermined speed range including consecutive values is set as an avoided speed range X1 (illustrated in FIGS. 6A and 6B). The controller 60 is configured to control the driving motor 45 to increase or decrease the rotation speed of the lubricant supply roller 15*a* away from the avoided speed range X1 in a case where the target speed Ra falls in the avoided speed range X1. For example, it is assumed that a range of from 120 rpm to 150 rpm is set as the avoided speed X. If the target speed Ra of the lubricant supply roller 15*a* is expected to enter the range from 120 rpm to 150 rpm, the rotation speed of the lubricant supply roller 15*a* is increased or reduced to prevent the target speed Ra from entering in that range. For example, the rotation speed is changed to 110 rpm.

By contrast, in Embodiment 1, in the case where the target speed Ra (i.e., rotation speed-to-be), to which the rotation speed of the lubricant supply roller 15*a* is changed according to the predetermined conditions, is expected to coincide with the avoided speed X and induce resonance, the rotation speed is adjusted to make the rotation speed-to-be inconsistent with the avoided speed X. Such adjustment of rotation speed inhibits significant vibration of the photoconductor drum 11 and resultant image density unevenness. That is, the meshing frequency of the gear train to transmit the driving force from the driving motor 45 to the lubricant supply roller 15*a* is inhibited from coinciding with the eigenfrequency (resonance frequency) of another component such as the photoconductor drum 11, the charging roller 12, or the writing device 2.

It is to be noted that, in a case where the rotation speed is increased to make the target speed Ra inconsistent with the avoided speed X, the amount of lubricant applied to the surface of the photoconductor drum 11 increases from the target amount, but lubrication of the surface of the photoconductor drum 11 is advantageously ensured.

By contrast, in a case where the rotation speed is reduced to make the target speed Ra inconsistent with the avoided speed X, the amount of lubricant applied to the surface of the photoconductor drum 11 decreases from the target amount, but consumption of the solid lubricant 15*b* is advantageously reduced.

In the present embodiment, the predetermined conditions, based on which the rotation speed of the lubricant supply roller 15*a* is changed, include at least one of an accumulative travel distance of the lubricant supply roller 15*a* (or the photoconductor drum 11) and ambient temperature and humidity around the lubricant supply device 15 (for example, absolute humidity). That is, based on the total driving time of the lubricant supply roller 15*a* or the ambient temperature and humidity, the controller 60 controls the driving motor 45 to change the rotation speed of the lubricant supply roller 15*a*.

Specifically, as the total travel distance (or total driving time) of the lubricant supply roller 15*a* (or the photoconductor drum 11) increases, the driving motor 45 (the rotation speed changer) consecutively (or stepwise) increases the rotation speed of the lubricant supply roller 15*a*.

More specifically, the image forming apparatus 1 includes a counter 49 (illustrated in FIG. 2) to count the number of printed sheets. Based on the number of printed sheets counted by the counter 49, the controller 60 indirectly calculates the total travel distance of the lubricant supply roller 15*a*. The controller 60 controls the driving motor 45 to progressively increase the rotation speed of the lubricant supply roller 15*a* as the total travel distance increases. This control is advantageous as follows. Even if lubricating capability of the lubricant supply device 15 to lubricate the photoconductor drum 11 gradually decreases over time, the rotation speed of the lubricant supply roller 15*a* is increased to cancel the decrease in the lubricating capability. Accordingly, excess and deficiency of lubricant supplied from the lubricant supply device 15 to the photoconductor drum 11 are inhibited over time.

It is to be noted that, although the rotation speed of the lubricant supply roller 15*a* is changed based on the data generated by the counter 49 in Embodiment 1, in another embodiment, the rotation speed of the lubricant supply roller 15*a* is changed based on the operation time of the driving motor 45 or the like.

Referring to FIG. 2, the image forming apparatus 1 further includes a temperature and humidity sensor 50 (i.e., an environment detector) disposed adjacent to the process cartridge 10Y to detect an ambient absolute humidity (temperature and humidity). It is to be noted that the absolute humidity detected by the temperature and humidity sensor 50 is obtained based on the temperature and the humidity detected by the temperature and humidity sensor 50.

Controlled by the controller 60, the driving motor 45 (the rotation speed changer) progressively (or stepwise) increases the rotation speed of the lubricant supply roller 15*a* as the absolute humidity detected by the temperature and humidity sensor 50 increases.

This control is advantageous as follows. Even if lubricating capability of the lubricant supply device 15 to lubricate the photoconductor drum 11 gradually decreases inherent to increases in ambient absolute humidity, the rotation speed of the lubricant supply roller 15*a* is increased to cancel the decrease in the lubricating capability. Accordingly, excess and deficiency of lubricant supplied from the lubricant supply device 15 to the photoconductor drum 11 are inhibited regardless of changes in temperature and humidity (i.e., environmental fluctuations).

It is to be noted that, although the rotation speed of the lubricant supply roller 15*a* is changed consecutively based on the change in temperature and humidity in Embodiment 1, in another embodiment, the rotation speed of the lubricant supply roller 15*a* is changed stepwise based on the change in temperature and humidity. For example, the controller 60 controls the driving motor 45 to increase the rotation speed of the lubricant supply roller 15*a* in three steps in accordance with three ranges of a low temperature range (e.g., 15° C. or lower), an ordinary temperature range (from 15° C. to 25° C.), and a high temperature range (25° C. or higher).

Figure 3:
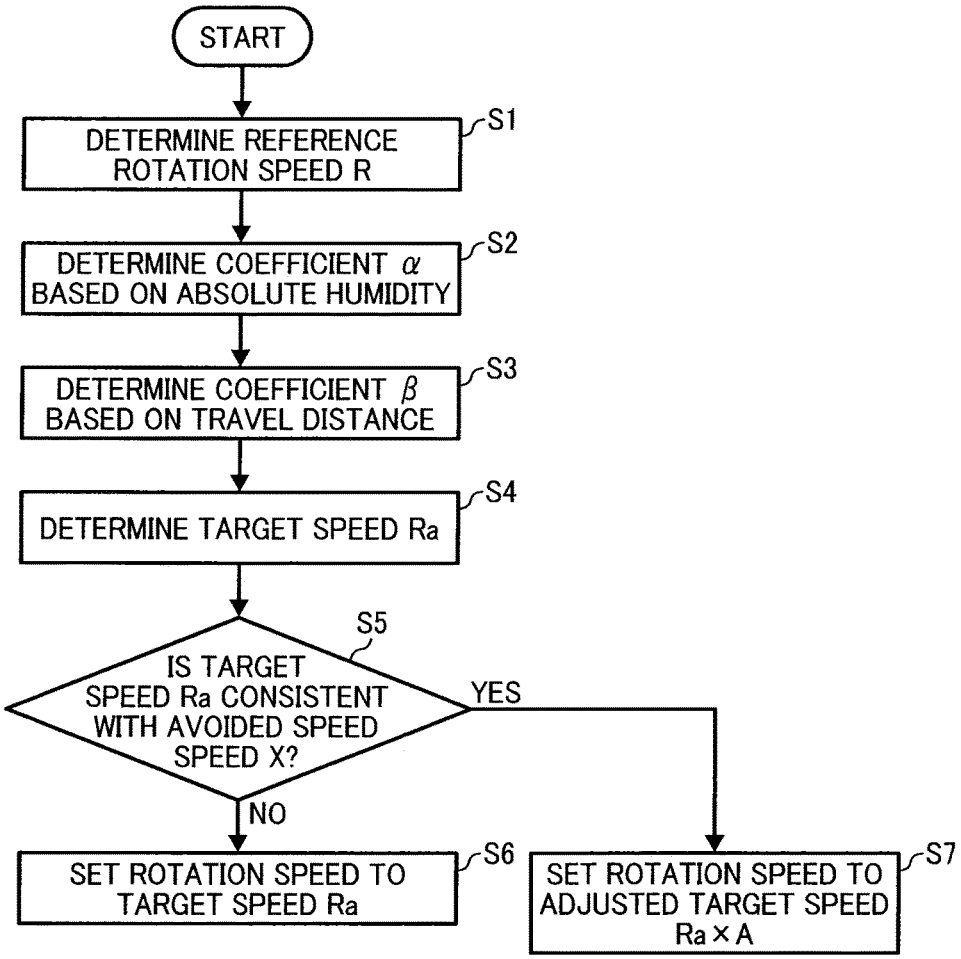
FIG. 3 is a flowchart of control to change the rotation speed of a lubricant supply roller according to Embodiment 1.

With reference to FIG. 3, descriptions are given below of changing the rotation speed of the lubricant supply roller 15*a* according to Embodiment 1.

At S1 in FIG. 3, based on the process linear speed at which image formation is executed, the controller 60 determines a reference rotation speed R of the lubricant supply roller 15*a*. In the image forming apparatus 1 according to Embodiment 1, since the low-speed mode is selectable in addition to the standard mode as described above, there are two reference rotation speeds, namely, a normal reference speed R1 and a lower reference speed R2, of the lubricant supply roller 15*a* in accordance with two process linear velocities. Specifically, at S1, the normal reference speed R1 is set in the standard mode, and the lower reference speed R2 is set in the low-speed mode.

It is to be noted that, in a configuration in which the process linear speed is not changed, the step S1 is omitted.

At S2, the controller 60 determines a coefficient α based on the detection result (absolute humidity detected) generated by the temperature and humidity sensor 50. The coefficient α is a correction coefficient to multiply the reference rotation speed R to change the rotation speed of the lubricant supply roller 15*a* for lubrication of the photoconductor drum 11 without excess and deficiency even when the temperature and the humidity (the absolute humidity) changes, as described above.

At S3, the controller 60 determines a coefficient 13 based on the detection result (total travel distance detected) generated by the counter 49. The coefficient is a correction coefficient to multiply the reference rotation speed R to change the rotation speed of the lubricant supply roller 15*a* for lubrication of the photoconductor drum 11 without excess and deficiency even when the lubricating capability decreases over time.

At S4, the controller 60 multiplies the reference rotation speed R (R1 or R2) with the coefficients α and β, thereby determining the target speed Ra (=R×α×β).

At S5, the controller 60 compares the target rotation speed with the avoided speed X and determines whether the target rotation speed coincides with the avoided speed X (i.e., rotation speed to be avoided).

When the target speed Ra does not coincide with the avoided speed X (No at S5), that is, resonance does not occur, the controller 60 sets the rotation speed of the lubricant supply roller 15*a* to the target speed Ra determined at S4. Then, image formation is executed while the controller 60 controls the driving motor 45 to rotate the lubricant supply roller 15*a* at the target speed Ra.

By contrast, when the target speed Ra is consistent with the avoided speed X (Yes at S5), resonance is expected to occur. Accordingly, the controller 60 multiplies the target speed Ra with the correction coefficient A (greater than 0 and except 1). Then, the target rotation speed becomes an adjusted target speed Ra×A. At S7, the controller 60 sets the rotation speed of the lubricant supply roller 15*a* to the adjusted target speed Ra×A (≠X). Then, image formation is executed while the controller 60 controls the driving motor 45 to rotate the lubricant supply roller 15*a* at the adjusted target speed Ra×A. This control operation reliably alleviates inconveniences such as the occurrence of uneven image density caused by resonance.

Although the target speed Ra is changed at the predetermined rate (multiplied by the correction coefficient A) at S7 in Embodiment 1, alternatively, a predetermined value Z can be added to or deducted from the target speed Ra (=Ra±Z) to make the target speed Ra inconsistent with the avoided speed X.

Specifically, when the ambient absolute humidity detected is greater than a threshold absolute humidity M (a predetermined absolute humidity), the driving motor 45 rotates the lubricant supply roller 15*a* at a speed increased from the target speed Ra by a predetermined increment B (or at a predetermined rate). When the ambient absolute humidity detected is lower than the threshold absolute humidity M, the driving motor 45 rotates the lubricant supply roller 15*a* at a speed reduced from the target speed Ra by a predetermined decrement C (or at a predetermined rate). It is to be noted that, in the case where the target speed Ra of the lubricant supply roller 15*a* is consistent with the avoided speed X (or one of multiple predetermined speeds), in Variation 1, the target speed Ra is adjusted based on the detected ambient absolute humidity.

Figure 4:
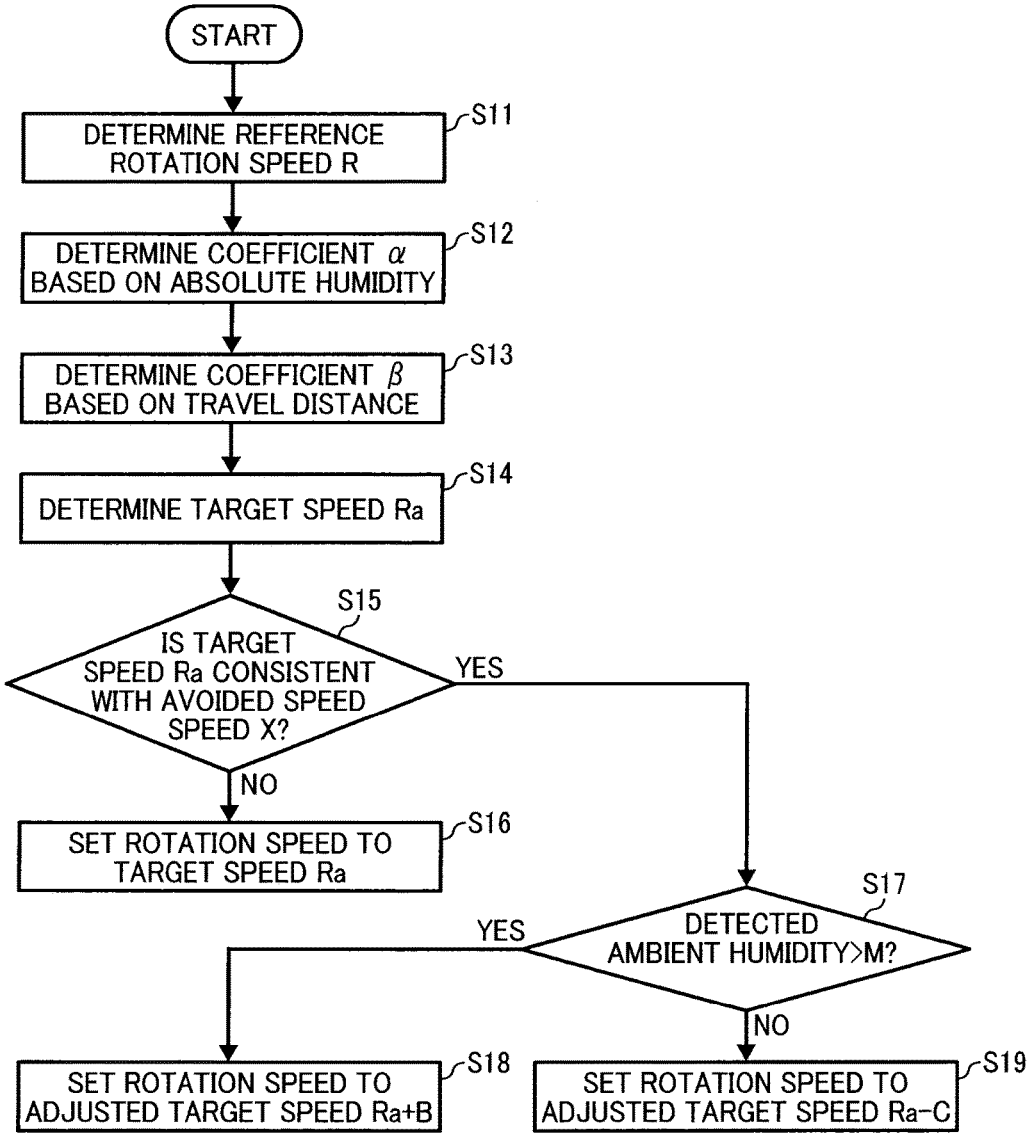
FIG. 4 is a flowchart of control to change the rotation speed of the lubricant supply roller according to Variation 1.

FIG. 4 is a flowchart of such control according to Variation 1. When the controller 60 determines that the target speed Ra is consistent with the avoided speed X (Yes at S15), the controller 60 determines whether or not the ambient absolute humidity is greater than the threshold absolute humidity M at S17 based on the detection by the temperature and humidity sensor 50.

When the controller 60 determines that the ambient absolute humidity is greater than the threshold absolute humidity M (Yes at S17), it means that the apparatus is in a relatively high temperature. In this state, the amount of lubricant supplied is likely to decrease, and the above-described resonance is likely to occur. Then, the process proceeds to step S18, and the predetermined increment B is added to the target speed Ra determined at S14, and the incremented rotation speed Ra+B (≠X) is set as the rotation speed different from avoided speed X. Then, image formation is executed while the controller 60 controls the driving motor 45 to rotate the lubricant supply roller 15*a* at the rotation speed Ra+B. This control operation inhibits shortage of the lubricant supplied to the photoconductor drum 11 while reliably alleviating inconveniences such as the occurrence of uneven image density caused by resonance.

By contrast, when the controller 60 determines that the ambient absolute humidity is not greater than the threshold absolute humidity M (No at S17), it means that the ambient temperature is relatively low. In this state, the amount of lubricant supplied is likely to increase, and the above-described resonance is likely to occur. Then, the process proceeds to step S19, and the predetermined decrement C is deducted from the target speed Ra determined at S14, and the decremented rotation speed Ra−C (≠X) is set as the rotation speed different from avoided speed X. Then, image formation is executed while the controller 60 controls the driving motor 45 to rotate the lubricant supply roller 15*a* at the rotation speed Ra−C. This control operation inhibits supplying excessive amount of lubricant to the photoconductor drum 11 while reliably alleviating inconveniences such as the occurrence of uneven image density caused by resonance.

Additionally, the image forming apparatus 1 according to Embodiment 1 can further include a torque detector 46, illustrated in FIG. 2, to detect the driving torque of the rotating lubricant supply roller 15*a*. The torque detector 46 detects the driving torque applied to the driving motor 45 based on changes in the current flowing to the driving motor 45.

Then, the controller 60 can be configured to control the driving motor 45 such that the degree of increment or decrement of the rotation speed of the lubricant supply roller 15*a* is increased when the driving torque detected by the torque detector 46 is greater. Specifically, the controller 60 is configured to control the driving motor 45 such that the predetermined rate (correction coefficient A) or the predetermined value is increased when the driving torque detected by the torque detector 46 is greater.

Such control is executed in the case where the target speed Ra of the lubricant supply roller 15*a* matches the avoided speed X. When the driving torque of the lubricant supply roller 15*a* in that case is greater, the width of the meshing frequency of the gear train, which transmits the driving force from the driving motor 45 to the lubricant supply roller 15*a*, is greater. Accordingly, there is a risk of the occurrence of the resonance described above unless the rotation speed is significantly changed from the avoided speed X.

Figure 5:
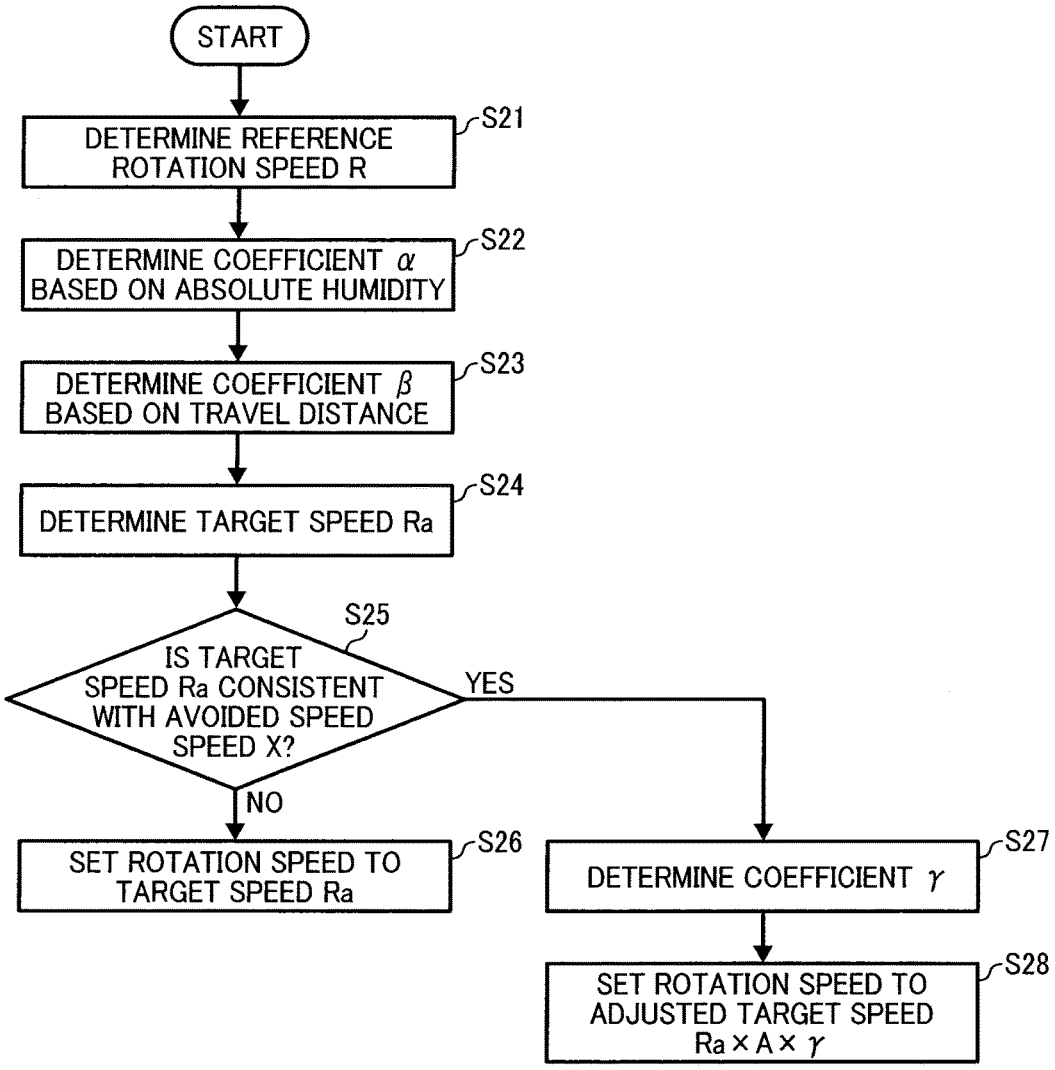
FIG. 5 is a flowchart of control to change the rotation speed of the lubricant supply roller according to Variation 2.

FIG. 5 is a flowchart of such control, according to Variation 2. When the controller 60 determines that the target speed Ra is consistent with the avoided speed X serving as the predetermined rotation speed (Yes at S25), at S27, the controller 60 determines a coefficient γ based on the driving torque detected by the torque detector 46. As described above, even when the conditions (e.g., absolute humidity, travel distance, and the like) are the same, the possibility of resonance is higher when the driving torque of the lubricant supply roller 15*a* is greater. The coefficient γ is used to multiply the above-described predetermined rate (the correction coefficient A) or the predetermined value to inhibit the occurrence of resonance under such conditions. The controller 60 increases the coefficient γ as the driving torque detected by the torque detector 46 increases.

Then, the target speed Ra determined at S24 is multiplied with the correction coefficient A and further multiplied with the coefficient γ determined at S27. At S28, the controller 60 sets the rotation speed of the lubricant supply roller 15*a* to an adjusted target speed Ra×A×γ (≠X). Then, image formation is executed while the controller 60 controls the driving motor 45 to rotate the lubricant supply roller 15*a* at the adjusted target speed Ra×A×γ.

This control operation reliably alleviates inconveniences such as the occurrence of uneven image density caused by resonance, regardless of changes in the driving torque of the lubricant supply roller 15*a*.

As described above, the image forming apparatus 1 according to Embodiment 1 includes the controller 60 configured to control the driving motor 45 so that the target speed Ra of the driving motor 45, which is determined based on the predetermined conditions, is increment or decrement not to coincide with the avoided speed X when the target speed Ra coincides with the predetermined avoided speed X.

With this configuration, even when the rotation speed of the lubricant supply roller 15*a* is changed, the photoconductor drum 11 is prevented from vibrating significantly, and uneven image density is inhibited.

Embodiment 2

Embodiment 2 is described below with reference to FIGS. 6A and 6B.

FIG. 6A is a graph illustrating a relation between the absolute humidity detected by the temperature and humidity sensor 50 and the rotation speed of the lubricant supply roller 15*a* in control of the lubricant supply device 15 according to Embodiment 2. FIG. 6B is a graph illustrating a relation between the total travel distance (substitutable with the total running time) of the lubricant supply roller 15*a* and the rotation speed of the lubricant supply roller 15*a* in control of the lubricant supply device 15 according to Embodiment 2.

In Embodiment 2, the range of the rotation speed of the lubricant supply roller 15*a* at which the possibility of resonance is high is predetermined, differently from Embodiment 1, in which the avoided speed X serving as the predetermined rotation speed (or multiple avoided speeds X) at which the possibility of resonance is high is predetermined.

The lubricant supply device 15 according to the present embodiment is similar to the lubricant supply device 15 of Embodiment 1 illustrated in FIG. 2. Specifically, the lubricant supply device 15 includes the solid lubricant 15*b*, the lubricant supply roller 15*a* to slidingly contact the solid lubricant 15*b* and supply lubricant to the photoconductor drum 11, the compression spring 15*c* to bias the solid lubricant 15*b* to the lubricant supply roller 15*a*, the lubricant holder to hold the solid lubricant 15*b*, and the leveling blade 15*f* to contact or abut the photoconductor drum 11 to level the lubricant supplied to the photoconductor drum 11 into a thin layer. The lubricant supply roller 15*a* includes an elastic layer that slidingly contacts the photoconductor drum 11.

Similar to Embodiment 1, the driving motor 45 drives the lubricant supply roller 15*a* (the lubricant supply device 15) and serves as the rotation speed changer to change the rotation speed of the lubricant supply roller 15*a* based on the predetermined condition or conditions (e.g., absolute humidity, total travel distance, or the like).

In the image forming apparatus 1 according to Embodiment 2, the controller 60 controls the driving motor 45 to vary the target speed Ra of the driving motor 45, which is determined based on the predetermined conditions, irregularly in a predetermined range (in which resonance can arise).

That is, in a case where the target speed Ra (i.e., rotation frequency or number of revolutions) of the lubricant supply roller 15*a* is not consistent with the avoided speed X but is in the predetermined speed range (i.e., the avoided speed range X1), the controller 60 controls the driving motor 45 (the rotation speed changer) so that the target speed Ra is changed to a speed outside the avoided speed range X1.

Specifically, referring to FIG. 6A, the controller 60 according to Embodiment 2 controls the driving motor 45 in principle so that the rotation speed of the lubricant supply roller 15*a* increases consecutively as the absolute humidity (temperature and humidity) detected by the temperature and humidity sensor 50 rises. In the graph illustrated in FIG. 6A, in which the abscissa represents absolute humidity and the ordinate represents the rotation speed of the lubricant supply roller 15*a*, the basic shape is linear as represented by a graph CPz (broken line). However, if the rotation speed is controlled to vary linearly (regularly) relative to the absolute humidity in the entire range of absolute humidity as represented by the graph CPz in FIG. 6A, the rotation speed of the lubricant supply roller 15*a* undesirably falls in the avoided speed range X1 (in which resonance can occur) in a certain absolute humidity range.

In view of the foregoing, in Embodiment 2, the rotation speed is controlled not to enter the avoided speed range X1 when the absolute humidity is in a predetermined range. Specifically, the rotation speed is controlled so that the rotation speed draws not the linear graph CPz (changes regularly in the entire absolute humidity range) but a graph CP represented by a solid line, which includes an irregular change range. In the graph CP, the rotation speed does not change proportionally to the absolute humidity in the predetermined absolute humidity range.

Additionally, referring to FIG. 6B, the controller 60 according to Embodiment 2 controls the driving motor 45 in principle so that the rotation speed of the lubricant supply roller 15*a* increases consecutively as the total travel distance counted by the counter 49 increases. In the graph illustrated in FIG. 6B, in which the abscissa represents total travel distance of the lubricant supply roller 15*a* and the ordinate represents the rotation speed of the lubricant supply roller 15*a*, the basic graph shape is stepwise as represented by a graph CQz (broken line). In the graph CQz in FIG. 6B, the rotation speed increases by a constant value as the total travel distance increases by a constant value. However, if the rotation speed is controlled to vary stepwise (regularly) relative to the absolute humidity in the entire absolute humidity range as represented by the graph CQz in FIG. 6B, the rotation speed of the lubricant supply roller 15*a* undesirably falls in the avoided speed range X1 (in which resonance can occur) when the total travel distance reaches a predetermined travel distance.

In view of the foregoing, in Embodiment 2, the rotation speed is controlled not to enter the avoided speed range X1 when the total travel distance is at the predetermined travel distance. Specifically, the rotation speed is controlled so that the rotation speed change draws not a regularly stairway (like the CQz) in the entire range but an irregular stairway in a certain range as represented by a solid graph CQ. In the graph CQ, the degree of change of the total travel distance relative to the rotation speed is different in a certain range.

As described above, in the image forming apparatus 1 according to Embodiment 2, the controller 60 controls the driving motor 45 to vary the target speed Ra of the driving motor 45, which is determined based on the predetermined conditions, irregularly in the predetermined range.

With this configuration, even when the rotation speed of the lubricant supply roller 15*a* is changed, the photoconductor drum 11 is prevented from vibrating significantly, and uneven image density is inhibited.

Embodiment 3

Embodiment 3 is described below with reference to FIGS. 7A through 9C.

Figure 7A:
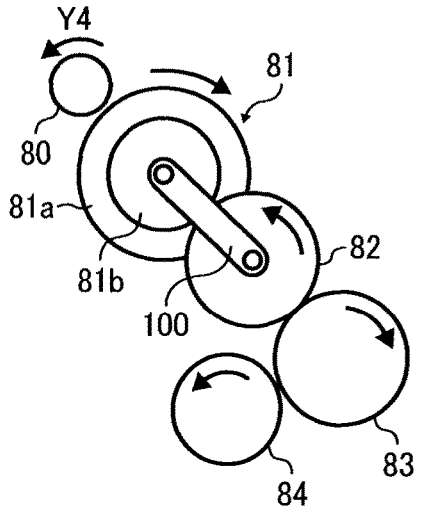
FIGS. 7A and 7B are schematic cross-sectional views of a gear train disposed in a lubricant supply device according to Embodiment 3.
Figure 7B:
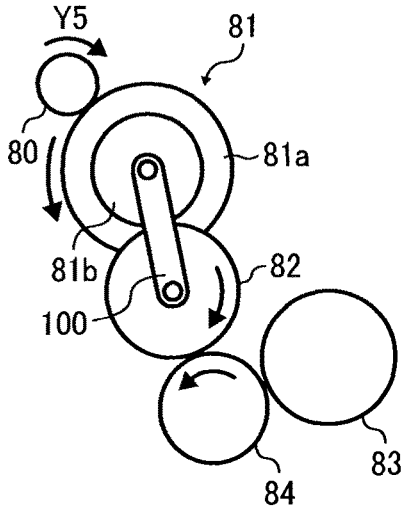
Figure 8A:
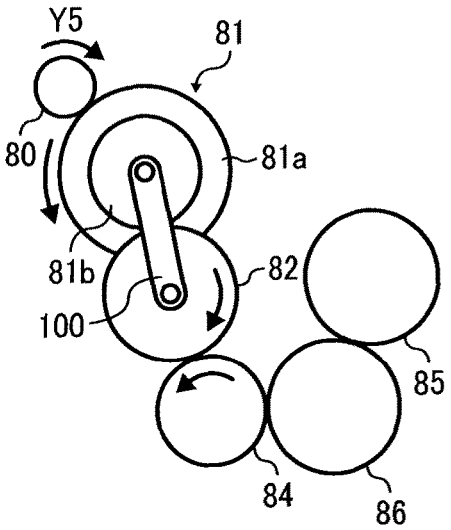
FIGS. 8A and 8B are schematic cross-sectional views of a variation of the gear train illustrated in FIGS. 7A and 7B.
Figure 8B:
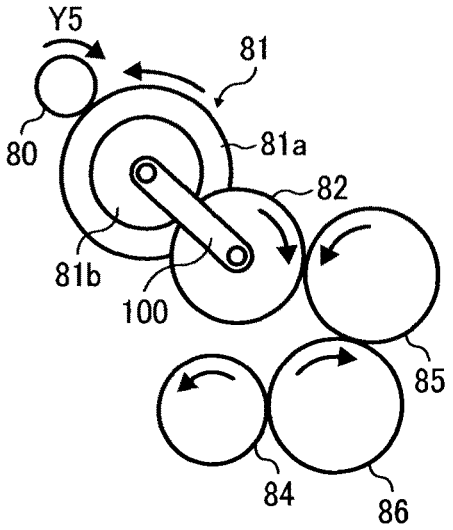
Figure 9A:
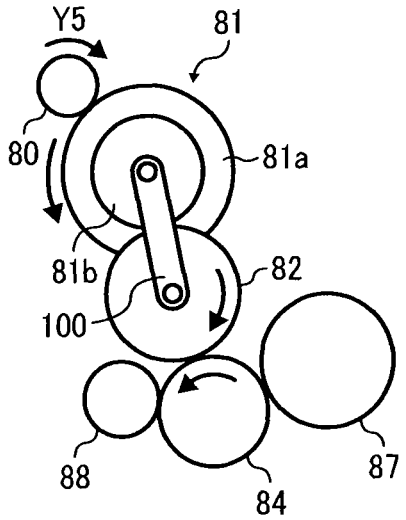
FIGS. 9A, 9B, and 9C are schematic cross-sectional views of another variation of the gear train illustrated in FIGS. 7A and 7B.
Figure 9B:
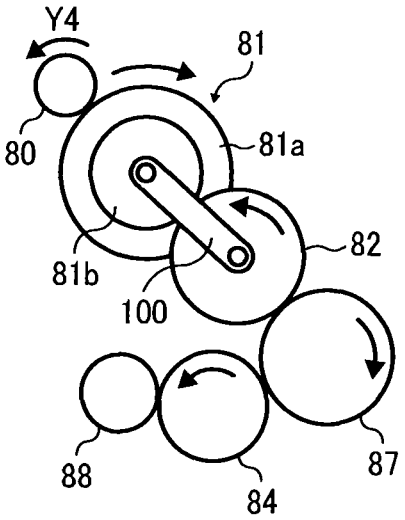
Figure 9C:
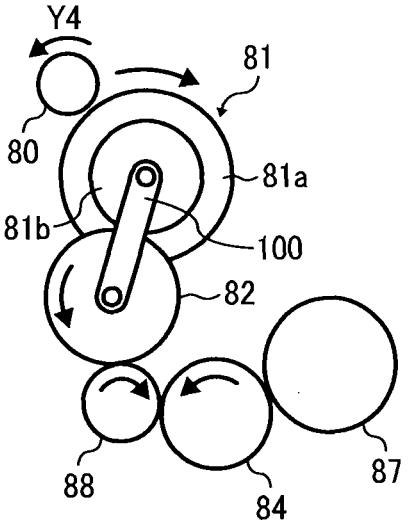

FIGS. 7A and 7B are schematic cross-sectional views of the gear train disposed in the lubricant supply device 15 and illustrate gear combinations switched by a gear combination changer. FIGS. 8A and 8B are schematic cross-sectional views of a variation of the gear train illustrated in FIGS. 7A and 7B. FIGS. 9A, 9B, and 9C are schematic cross-sectional views of another variation of the gear train illustrated in FIGS. 7A and 7B.

In Embodiment 3, when resonance is likely to arise, the gear combination changer switches the gear combination to transmit driving force from the driving motor 45 to the lubricant supply roller 15*a*, thereby changing the eigenfrequency relating to the driving of the lubricant supply roller 15*a*, differently from Embodiment 1, in which the rotation speed of the lubricant supply roller 15*a* is changed when resonance is likely to arise.

The lubricant supply device 15 according to the present embodiment is similar to the lubricant supply device 15 of Embodiment 1 illustrated in FIG. 2. Specifically, the lubricant supply device 15 includes the solid lubricant 15*b*, the lubricant supply roller 15*a* to slidingly contact the solid lubricant 15*b* and supply lubricant to the photoconductor drum 11, the compression spring 15*c* to bias the solid lubricant 15*b* to the lubricant supply roller 15*a*, the lubricant holder to hold the solid lubricant 15*b*, and the leveling blade 15*f* to contact or abut the photoconductor drum 11 to level the lubricant supplied to the photoconductor drum 11 into a thin layer. The lubricant supply roller 15*a* includes an elastic layer that slidingly contacts the photoconductor drum 11.

Similar to Embodiment 1, the driving motor 45 drives the lubricant supply roller 15*a* (the lubricant supply device 15) and serves as the rotation speed changer to change the rotation speed of the lubricant supply roller 15*a* based on the predetermined condition or conditions such as the process linear speed, environment (absolute humidity), total travel distance, and the like.

The lubricant supply device 15 according to Embodiment 3 includes the gear combination changer to switch the combination of the gear train to transmit the driving force from the driving motor 45 serving as the driver to the lubricant supply roller 15*a*, thereby changing the eigenfrequency relating to the driving thereof.

Specifically, as illustrated in FIGS. 7A and 7B, the gear train includes a driving gear 80 disposed on a motor shaft of the driving motor 45, a driven gear 84 disposed on a shaft of the lubricant supply roller 15*a*, and relay gears 81, 82, and 83 disposed between the driving gear 80 and the driven gear 84. The gear combination changer includes the relay gear 82 that is swingable to change the combination of the relay gears 81, 82, and 83 and a swing arm 100 to rotatably support the relay gear 82.

More specifically, the relay gear 81 (i.e., a first relay gear) is a two-stage gear and includes a lower gear 81*a* and an upper gear 81*b*. The driving gear 80 meshes with the lower gear 81*a*, and the upper gear 81*b* meshes with the relay gear 82 (i.e., second relay gear that is swingable).

The relay gear 82 rotatably supported by the swing arm 100 is swingable centered on the rotation shaft of the relay gear 81 regardless of rotation of the relay gear 81 or rotation of the relay gear 82. When the relay gear 82, together with the swing arm 100, swings to the position illustrated in FIG. 7A and retained at that position, the relay gear 82 meshes with the relay gear 83 (i.e., a third relay gear) meshing with the driven gear 84. By contrast, when the relay gear 82, together with the swing arm 100, swings to the position illustrated in FIG. 7B and retained at that position, the relay gear 82 meshes with the driven gear 84 without meshing with the relay gear 83.

That is, the swing arm 100 serving as the gear combination changer can switch the gear train to transmit the driving force from the driving motor 45 to the lubricant supply roller 15*a* between a combination illustrating in FIG. 7A, which includes the relay gears 81, 82, and 83 (the first, second, and third relay gears), and an alternative combination illustrated in FIG. 7B, which includes the first and the second relay gears 81 and 82 (the first and second relay gears). It is to be noted that, in Embodiment 3, the gear combination illustrated in FIG. 7A is a reference combination used in an ordinary state. Additionally, a shaft of the swing arm 100 around which the swing arm 100 swings is connected to a motor, and the motor causes the swing arm 100 to swing independent of rotation of the relay gear 81 or the relay gear 82.

When the combination of the gears is changed, the meshing frequency of the gear train changes. Accordingly, the eigenfrequency relating to the driving of the lubricant supply roller 15*a* (the lubricant supply device 15) is changed. That is, the eigenfrequency (the meshing frequency of the gear train) in driving the lubricant supply roller 15*a* with the gear combination illustrated in FIG. 7A is different from the eigenfrequency in driving the lubricant supply roller 15*a* with the gear combination illustrated in FIG. 7B.

Additionally, in Embodiment 3, the driving motor 45 is configured to rotate in both of normal and reverse directions not to change the rotation direction of the lubricant supply roller 15*a* when the swing arm 100 (the gear combination changer) switches the gear train from the reference combination illustrated in FIG. 7A to the alternative combination illustrated in FIG. 7B.

Specifically, when the gear train is in the reference combination illustrated in FIG. 7A, the driving motor 45, which is rotatable in the normal and the reverse directions, is driven in the normal direction. Then, the driving force is transmitted from the driving gear 80 rotating in the direction indicated by arrow Y4 in FIG. 7A (counterclockwise in FIG. 7A) via the relay gears 81, 82, and 83 to the driven gear 84, and the lubricant supply roller 15*a* (in FIG. 2) rotates counterclockwise in FIG. 7A, which is identical to the direction indicated by arrow Y3 in FIG. 2, together with the driven gear 84. By contrast, when the gear train is in the alternative combination illustrated in FIG. 7B, the driving motor 45 is driven in the reverse direction as indicated by arrow Y5. Then, the driving force is transmitted from the driving gear 80 rotating in the direction indicated by arrow Y5 in FIG. 7B (clockwise in FIG. 7B) via the relay gears 81 and 82 to the driven gear 84, and the lubricant supply roller 15*a* rotates counterclockwise in FIG. 7B (identical to the direction indicated by arrow Y3 in FIG. 2), together with the driven gear 84. It is to be noted that, in the state illustrated in FIG. 7B, the relay gear 83 (the third relay gear) meshes with the driven gear 84 and rotates idle.

The lubricant supply device 15 further includes a position sensor to optically detect the position of the swing arm 100. Based on the detection result generated by the position sensor, the controller 60 controls the motor to swing the swing arm 100 (the gear combination changer).

In the image forming apparatus 1 according to Embodiment 3 configured as described above, in the state in which the gear train is in the reference combination illustrated in FIG. 7A and the target speed Ra of the lubricant supply roller 15*a* is consistent with the avoided speed X as described in Embodiment 1, the controller 60 controls the swing arm 100 to switch the gear combination from the reference combination to the alternative combination illustrated in FIG. 7B.

After the reference combination is switched to the alternative combination illustrated in FIG. 7B and a sequence of lubricating actions by the lubricant supply device 15 (image formation process) is completed, the swing arm 100 serving as the gear combination changer returns the gear combination to the reference combination illustrated in FIG. 7A.

Similar to Embodiment 1, the avoided speed X is a rotation speed that makes the meshing frequency of the gear train (in the reference combination illustrated in FIG. 7A) to coincide with the eigenfrequency (resonance frequency) of another component such as the photoconductor drum 11, the charging roller 12, or the writing device 2. Such coincidence will induce resonance and is to be avoided.

By contrast, in Embodiment 3, in the case where the target speed Ra of the lubricant supply roller 15*a* matches the avoided speed X, the gear train is switched from the reference combination illustrated in FIG. 7A to the alternative combination illustrated in FIG. 7B so that the meshing frequency of the gear train to transmit the driving force to the lubricant supply roller 15*a* does not coincide with the eigenfrequency (resonance frequency) of another component such as the photoconductor drum 11, the charging roller 12, or the writing device 2. Accordingly, resonance is inhibited, and the photoconductor drum 11 is inhibited from significantly vibrating. Thus, inconveniences such as uneven image density are inhibited.

It is to be noted that, in Embodiment 3 similar to Embodiment 1, multiple avoided speeds X can be set, and the controller 60 can be configured to control the gear combination changer to switch the gear train from the reference combination illustrated in FIG. 7A to the alternative combination illustrated in FIG. 7B in the case where the target speed Ra of the lubricant supply roller 15*a* is consistent with one of the multiple avoided speeds X. Further, consecutive values in a predetermined speed range can be set as the above-described avoided speeds X (the predetermined speeds), and the controller 60 can be configured to control the gear combination changer to switch the gear train from the reference combination illustrated in FIG. 7A to the alternative combination illustrated in FIG. 7B in the case where the target speed Ra of the lubricant supply roller 15*a* falls in the range of the avoided speeds X.

The image forming apparatus 1 according to Embodiment 3 includes the torque detector 46, illustrated in FIG. 2, to detect the driving torque of the rotating lubricant supply roller 15*a*. The controller 60 changes the avoided speed X or the avoided speeds X in accordance with the driving torque detected by the torque detector 46.

Specifically, the controller 60 preliminarily stores a control data table defining the relation between the driving torque of the lubricant supply roller 15*a* and the avoided speed X to be changed. The controller 60 refers to the control data table, retrieves the driving torque detected by the torque detector 46, and changes the avoided speed X, based on which the gear combination changer switches the gear combination.

Such control is executed in the case where the target speed Ra of the lubricant supply roller 15*a* matches the avoided speed X. When the driving torque of the lubricant supply roller 15*a* in that case is greater, the width of the meshing frequency of the gear train, which transmits the driving force from the driving motor 45 to the lubricant supply roller 15*a*, is greater. Accordingly, there is a risk of the occurrence of the resonance described above unless the avoided speed X is changed to a proper value.

It is to be noted that, in Embodiment 3, when the gear combination changer changes the gear combination, the direction of rotation of the driving motor 45 (the driving gear 80) is changed simultaneously.

By contrast, in a variation illustrated in FIGS. 8A and 8B, the direction of rotation of the driving motor 45 (the driving gear 80) is not changed but is kept at the predetermined direction (clockwise in FIGS. 8A and 8B) when the gear combination changer changes the gear combination. In FIGS. 8A and 8B, the gear train includes relay gears 85 and 86 instead of the relay gear 83.

Specifically, FIG. 8A illustrates the gear train being in the reference combination. In FIG. 8A, the driving force is transmitted from the driving gear 80 rotating in the direction indicated by arrow Y5 in FIG. 8A (clockwise in FIG. 8A) via the relay gears 81 and 82 to the driven gear 84, and the lubricant supply roller 15*a* (illustrated in FIG. 2) rotates counterclockwise in FIG. 8A, together with the driven gear 84. By contrast, when the swing arm 100 switches the reference combination to the alternative combination illustrated FIG. 8B, the driving force is transmitted from the driving gear 80 rotating clockwise in FIG. 8A, indicated by arrow Y5, via the relay gears 81 and 82 and via the relay gears 85 and 86 to the driven gear 84. Then, the lubricant supply roller 15*a* (illustrated in FIG. 2) rotates counterclockwise in FIG. 8B, together with the driven gear 84.

This configuration can attain effects similar to those attained by Embodiment 3 described above.

In Embodiment 3, there is only one alternative combination to which the gear combination changer changes the gear combination from the reference combination. By contrast, in another variation illustrated in FIGS. 9A, 9B, and 9C, when the gear combination changer changes the gear combination from the reference combination, an alternative is selected from multiple combinations of gears. In FIGS. 9A, 9B, and 9C, the gear train includes relay gears 87 and 88 instead of the relay gears 85 and 86 illustrated in FIGS. 8A and 8B.

Specifically, the swing arm 100 (the gear combination changer) changes, by swing, the gear train from the reference combination illustrated in FIG. 9A to either a first alternative combination illustrated in FIG. 9B or a second alternative combination illustrated in FIG. 9C.

More specifically, in FIG. 8A in which the gear train is in the reference combination, the driving force is transmitted from the driving gear 80 rotating clockwise in FIG. 9A, indicated by arrow Y5, via the relay gears 81 and 82 to the driven gear 84, and the lubricant supply roller 15*a* rotates counterclockwise in FIG. 8A, together with the driven gear 84. By contrast, when the swing arm 100 swings to switch the gear train to the first alternative combination illustrated FIG. 9B, the driving force is transmitted from the driving gear 80 rotating counterclockwise in FIG. 9B, indicated by arrow Y4, via the relay gears 81, 82, and 87 to the driven gear 84. Then, the lubricant supply roller 15*a* (illustrated in FIG. 2) rotates counterclockwise in FIG. 9B, together with the driven gear 84. Alternatively, when the swing arm 100 swings to switch the gear train to the second alternative combination illustrated FIG. 9C, the driving force is transmitted from the driving gear 80 rotating counterclockwise in FIG. 9C, indicated by arrow Y4, via the relay gears 81, 82, and 88 to the driven gear 84. Then, the lubricant supply roller 15*a* rotates counterclockwise in FIG. 9C, together with the driven gear 84.

It is to be noted that, the relay gears 87 and 88 are different in the number of tooth so that the meshing frequency of the gear train is different between the first alternative combination illustrated in FIG. 9B and the second alternative combination illustrated in FIG. 9C.

Thus, in this variation, when the gear combination changer changes the gear combination from the reference combination, the alternative combination is selectable from the multiple gear combinations. This configuration is advantageous in that the meshing frequency can be changed in a wider range (increased number of alternatives to which the meshing frequency is changed), and the effect of Embodiment 3 is ensured.

As described above, the lubricant supply device 15 according to Embodiment 3 includes the gear combination changer (e.g., the swingable relay gear 82 supported by the swing arm 100) to switch the gear combination to transmit the driving force from the driving motor 45 (serving as the driver as well as the rotation speed changer) to the lubricant supply roller 15*a*, thereby changing the eigenfrequency in driving the lubricant supply roller 15*a*. In the state in which the gear train is in the reference combination and the target speed Ra of the lubricant supply roller 15*a* is consistent with the predetermined avoided speed X, the controller 60 controls the gear combination changer to switch the gear combination from the reference combination to the alternative combination.

With this configuration, even when the rotation speed of the lubricant supply roller 15*a* is changed, the photoconductor drum 11 is prevented from vibrating significantly, and uneven image density is inhibited.

Embodiment 4

Embodiment 4 is described below with reference to FIGS. 10A through 12C.

Figure 10A:
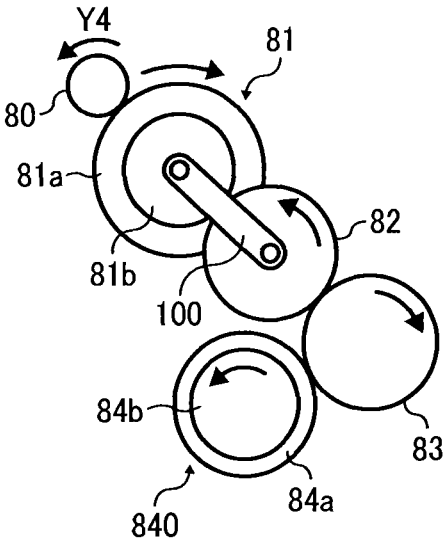
FIGS. 10A and 10B are schematic cross-sectional views of a gear train disposed in a lubricant supply device according to Embodiment 4.
Figure 10B:
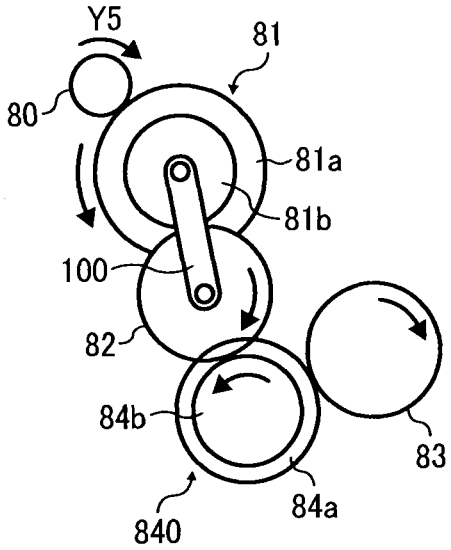
Figure 11A:
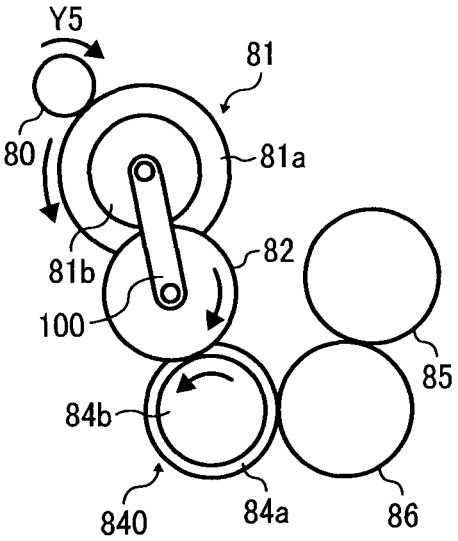
FIGS. 11A and 11B are schematic cross-sectional views of a variation of the gear train illustrated in FIGS. 10A and 10B.
Figure 11B:
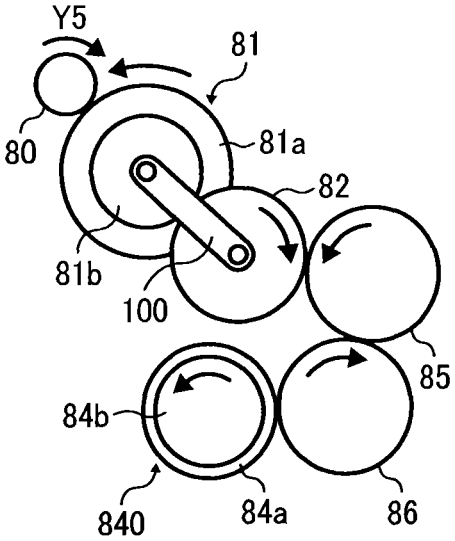
Figure 12A:
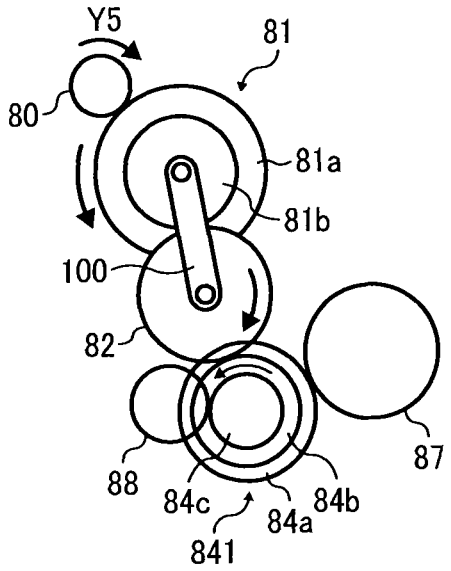
FIGS. 12A, 12B, and 12C are schematic cross-sectional views of another variation of the gear train illustrated in FIGS. 10A and 10B.
Figure 12B:
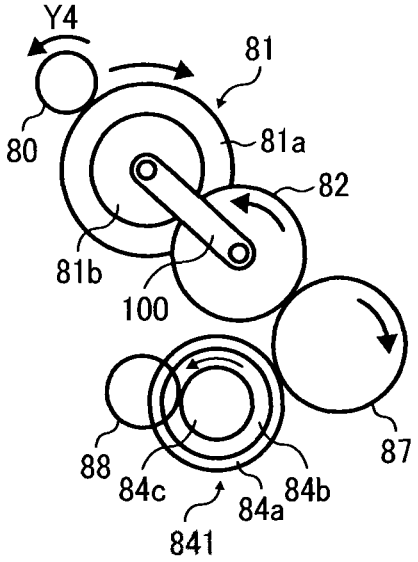
Figure 12C:
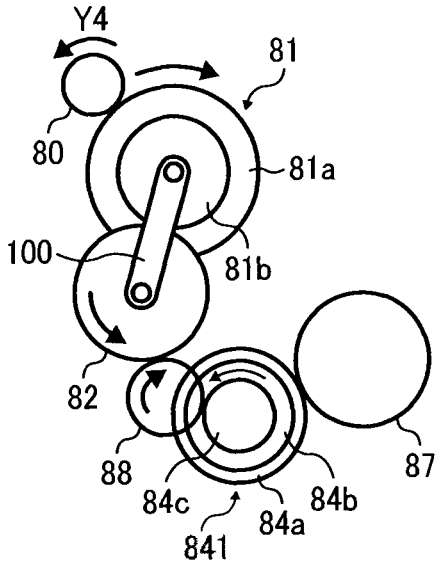

FIGS. 10A and 10B are schematic cross-sectional views of the gear train disposed in the lubricant supply device 15 according to Embodiment 4 and illustrate gear combinations switched by the gear combination changer. FIGS. 11A and 11B are schematic cross-sectional views of a variation of the gear train illustrated in FIGS. 10A and 10B. FIGS. 12A, 12B, and 12C are schematic cross-sectional views of another variation.

In Embodiment 4, the gear combination changer switches the gear combination to transmit driving force from the driving motor 45 to the lubricant supply roller 15*a*, thereby changing the eigenfrequency relating to the driving thereof, differently from Embodiment 1, in which the rotation speed of the lubricant supply roller 15*a* is changed when resonance is likely to arise.

The lubricant supply device 15 according to the present embodiment is similar to the lubricant supply device 15 of Embodiment 1 illustrated in FIG. 2. Specifically, the lubricant supply device 15 includes the solid lubricant 15*b*, the lubricant supply roller 15*a* to slidingly contact the solid lubricant 15*b* and supply lubricant to the photoconductor drum 11, the compression spring 15*c* to bias the solid lubricant 15*b* to the lubricant supply roller 15*a*, the lubricant holder to hold the solid lubricant 15*b*, and the leveling blade 15*f* to contact or abut the photoconductor drum 11 to level the lubricant supplied to the photoconductor drum 11 into a thin layer. The lubricant supply roller 15*a* includes an elastic layer that slidingly contacts the photoconductor drum 11.

Similar to Embodiment 1, the driving motor 45 in Embodiment 4 drives the lubricant supply roller 15*a* (the lubricant supply device 15) and serves as the rotation speed changer to change the rotation speed of the lubricant supply roller 15*a* based on the predetermined condition or conditions such as the process linear speed, environment (absolute humidity), total travel distance, and the like.

Similar to Embodiment 3, the lubricant supply device 15 according to Embodiment 4 includes the gear combination changer to switch the gear combination to transmit the driving force from the driving motor 45 serving as the driver to the lubricant supply roller 15*a*, thereby changing the eigenfrequency in driving the lubricant supply roller 15*a*.

Differently from the gear combination changer of Embodiment 3, the gear train of Embodiment 4 is configured to change the rotation speed of the lubricant supply roller 15*a* when the gear combination changer changes the gear combination from the reference combination.

Specifically, a driven gear 840 disposed on the shaft of the lubricant supply roller 15*a* is a two-stage gear including a first driven gear 84*a* and a second driven gear 84*b*.

The relay gear 81 (i.e., the first relay gear) is two-staged and includes the lower gear 81*a* meshing with the driving gear 80 and the upper gear 81*b* meshing with the relay gear 82 (i.e., the second relay gear) that is swingable. The relay gear 82 rotatably supported by the swing arm 100 is swingable centered on the rotation shaft of the relay gear 81 regardless of rotation of the relay gear 81 or rotation of the relay gear 82.

When the relay gear 82, together with the swing arm 100, swings to the position illustrated in FIG. 10A and retained at that position, the relay gear 82 meshes with the relay gear 83 (i.e., the third relay gear) meshing with the first driven gear 84*a* of the two-stage driven gear 840. By contrast, when the relay gear 82, together with the swing arm 100, swings to the position illustrated in FIG. 10B and retained at that position, the relay gear 82 meshes with the second driven gear 84*b* of the two-stage driven gear 840 without meshing with the relay gear 83.

That is, the swing arm 100 serving as the gear combination changer can switch the gear combination to transmit the driving force from the driving motor 45 to the lubricant supply roller 15*a* between the gear combination illustrating in FIG. 10A, which includes the relay gears 81, 82, and 83 (the first, second, and third relay gears) and the first driven gear 84*a*, and an alternative combination illustrated in FIG. 10B, which includes the first and the second relay gears 81 and 82 (the first and second relay gears) and the second driven gear 84*b*. In Embodiment 4, the gear combination illustrated in FIG. 10A is a reference combination used in an ordinary state.

When the combination of the gears is changed, the meshing frequency of the gear train changes. Accordingly, the eigenfrequency relating to the driving of the lubricant supply roller 15*a* (the lubricant supply device 15) is changed. That is, the eigenfrequency (the meshing frequency of the gear train) in driving the lubricant supply roller 15*a* with the gear combination illustrated in FIG. 10A is different from the eigenfrequency in driving the lubricant supply roller 15*a* with the gear combination illustrated in FIG. 10B.

Further, in Embodiment 4, the driven gear 840 (the first driven gear 84*a* and the second driven gear 84*b*) is configured so that the rotation speed of the lubricant supply roller 15*a* (the lubricant supply device 15) being driven with the reference gear combination illustrated FIG. 10A is smaller than the rotation speed of the lubricant supply roller 15*a* being driven with the gear combination illustrated in FIG. 10B. In other words, when the reference combination illustrated in FIG. 10A is switched to the gear combination illustrated in FIG. 10B, the rotation speed of the lubricant supply roller 15*a* is increased.

Additionally, similar to Embodiment 3, the driving motor 45 in Embodiment 4 is configured to rotate in both of normal and reverse directions not to change the rotation direction of the lubricant supply roller 15*a* when the swing arm 100 (the gear combination changer) switches the gear train from the reference combination illustrated in FIG. 10A to the alternative combination illustrated in FIG. 10B.

In the lubricant supply device 15 according to Embodiment 4 configured as described above, in the state in which the gear train is in the reference combination illustrated in FIG. 10A and the target speed Ra, to which the driving motor 45 (the rotation speed changer) changes the rotation speed of the lubricant supply roller 15*a* based on the predetermined condition, is consistent with the avoided speed X (or one of multiple avoided speeds X) similar to Embodiment 1, the swing arm 100 switches the reference combination illustrated in FIG. 10A to the alternative combination illustrated in FIG. 10B.

After the reference combination is switched to the alternative combination illustrated in FIG. 10B and a sequence of lubricating actions by the lubricant supply device 15 (image formation process) is completed, the swing arm 100 serving as the gear combination changer returns the gear combination illustrated in FIG. 10B to the reference combination illustrated in FIG. 10A.

Similar to Embodiment 1, the avoided speed X is a rotation speed that makes the meshing frequency of the gear train (in the reference combination illustrated in FIG. 10A) to coincide with the eigenfrequency (resonance frequency) of another component such as the photoconductor drum 11, the charging roller 12, or the writing device 2. Such coincidence will induce resonance and is to be avoided.

By contrast, in Embodiment 4, in the case where the target speed Ra of the lubricant supply roller 15*a* matches the avoided speed X, the gear train is switched from the reference combination illustrated in FIG. 10A to the alternative combination illustrated in FIG. 10B so that the meshing frequency of the gear train to transmit the driving force to the lubricant supply roller 15*a* does not coincide with the eigenfrequency (resonance frequency) of another component such as the photoconductor drum 11, the charging roller 12, or the writing device 2. Accordingly, resonance is inhibited, and the photoconductor drum 11 is inhibited from significantly vibrating. Thus, inconveniences such as uneven image density are inhibited.

Additionally, in Embodiment 4, in the case where the target speed Ra of the lubricant supply roller 15*a* is consistent with the avoided speed X that induces resonance, the gear combination to transmit the driving force from the driving motor 45 to the lubricant supply roller 15*a* is switched to the gear combination illustrated in FIG. 10B, thereby changing (increasing) the rotation speed not to coincide with the avoided speed X. Such adjustment of rotation speed inhibits significant vibration of the photoconductor drum 11 and resultant image density unevenness.

Here, in a case where, with the switching of the gear combination by the gear combination changer, the rotation speed of the lubricant supply roller 15*a* is increased to make the target speed Ra inconsistent with the avoided speed X as in Embodiment 4, the amount of lubricant applied to the surface of the photoconductor drum 11 increases from the target amount, but lubrication of the surface of the photoconductor drum 11 is advantageously ensured.

Alternatively, the gear combination changer can switch the gear combination so that the rotation speed of the lubricant supply roller 15*a* is decreased to make the target speed Ra inconsistent with the avoided speed X. For example, in the configuration illustrated in FIGS. 10A and 10B, not the gear combination illustrated in FIG. 10A but the gear combination illustrated in FIG. 10B serves as the reference combination. In this case, although the amount of lubricant applied to the surface of the photoconductor drum 11 decreases from the target amount, consumption of the solid lubricant 15*b* is advantageously restricted.

The image forming apparatus 1 according to Embodiment 4 includes the torque detector 46, illustrated in FIG. 2, to detect the driving torque of the rotating lubricant supply roller 15*a*. The controller 60 changes the avoided speed X or the multiple avoided speeds X in accordance with the driving torque detected by the torque detector 46.

Specifically, the controller 60 preliminarily stores a control data table defining the relation between the driving torque of the lubricant supply roller 15*a* and the avoided speed X to be changed. The controller 60 refers to the control data table, retrieves the driving torque detected by the torque detector 46, and changes the avoided speed X, based on which the gear combination changer switches the gear combination.

Such control is executed in the case where the target speed Ra of the lubricant supply roller 15*a* matches the avoided speed X. When the driving torque of the lubricant supply roller 15*a* in that case is greater, the width of the meshing frequency of the gear train, which transmits the driving force from the driving motor 45 to the lubricant supply roller 15*a*, is greater. Accordingly, there is a risk of the occurrence of the resonance described above unless the avoided speed X is changed to a proper value.

It is to be noted that, in Embodiment 4, when the gear combination changer changes the gear combination, the direction of rotation of the driving motor 45 (the driving gear 80) is changed simultaneously.

By contrast, in a variation illustrated in FIGS. 11A and 11B, the direction of rotation of the driving motor 45 (the driving gear 80) is not changed but is kept at the predetermined direction (clockwise in FIGS. 11A and 11B) when the gear combination changer changes the combination of gears.

Specifically, FIG. 11A illustrates the gear train being in the reference combination. In FIG. 11A, the driving force is transmitted from the driving gear 80 rotating clockwise in FIG. 11A (indicated by arrow Y5) via the relay gears 81 and 82 to the second driven gear 84*b*, and the lubricant supply roller 15*a* (illustrated in FIG. 2) rotates counterclockwise in FIG. 11A, together with the driven gear 840. By contrast, when the swing arm 100 switches the reference combination to the alternative combination illustrated FIG. 11B, the driving force is transmitted from the driving gear 80 rotating clockwise in FIG. 11B, indicated by arrow Y5, via the relay gears 81, 82, 85, and 86 to the first driven gear 84*a*. Then, the lubricant supply roller 15*a* rotates counterclockwise in FIG. 11B, together with the driven gear 840.

This configuration can attain effects similar to those attained by Embodiment 4 described above.

Additionally, the gear train of Embodiment 4 is configured to accelerate the rotation speed of the lubricant supply roller 15*a* when the gear combination changer changes the gear combination from the reference combination.

Alternatively, the combination of the relay gears can be configured to decelerate the rotation speed of the lubricant supply roller 15*a* when the swing arm 100 (the gear combination changer) swings to change the gear train from the reference combination illustrated in FIG. 11A to the gear combination illustrated in FIG. 11B.

Further, referring to FIGS. 12A, 12B, and 12C, the gear train can have the first and second alternative combinations illustrated in FIGS. 12B and 12C to decrease and increase, respectively, the driving speed transmitted to the lubricant supply roller 15*a* when the swing arm 100 (the gear combination changer), controlled by the controller 60, swings to change the gear train from the reference combination illustrated in FIG. 12A. The configuration illustrated in FIGS. 12A, 12B, and 12C includes a three-stage driven gear 841 having first, second, and third driven gears 84*a*, 84*b*, and 84*c*.

Specifically, when the gear train is in the reference combination illustrated in FIG. 12A, the driving force is transmitted from the driving gear 80 rotating clockwise in FIG. 12A (indicated by arrow Y5) via the relay gears 81 and 82 to the second driven gear 84*b* of the driven gear 841, and the lubricant supply roller 15*a* (illustrated in FIG. 2) rotates counterclockwise in FIG. 12A, together with the driven gear 841. By contrast, to decrease the rotation speed, the swing arm 100 swings to switch the gear train to the first alternative combination illustrated FIG. 12B, and the driving force is transmitted from the driving gear 80 rotating counterclockwise in FIG. 12B, indicated by arrow Y4, via the relay gears 81, 82, and 87 to the first driven gear 84*a* of the driven gear 841. Then, the lubricant supply roller 15*a* (illustrated in FIG. 2) rotates counterclockwise in FIG. 12B, together with the driven gear 841. Alternatively, to increase the rotation speed, the swing arm 100 swings to switch the gear train to the second alternative combination illustrated FIG. 12C, and the driving force is transmitted from the driving gear 80 rotating counterclockwise in FIG. 12C, indicated by arrow Y4, via the relay gears 81, 82, and 88 to the third driven gear 84*c* of the driven gear 841. Then, the lubricant supply roller 15*a* (illustrated in FIG. 2) rotates counterclockwise in FIG. 12C, together with the driven gear 841.

It is to be noted that, the number of tooth of each of the relay gear 87 (the third relay gear), the relay gear 88 (the fourth relay gear), and the driven gear 841 (the first, second, and third driven gears 84*a*, 84*b*, and 84*c*) are set to enable the above-described acceleration, deceleration, and meshing frequency change.

Using the relay gear combinations illustrated in FIGS. 12A through 12C, the controller 60 can be configured to control the gear combination changer (the swingable relay gear 82) to either increase or decrease the rotation speed of the lubricant supply roller 15*a* according to the ambient absolute humidity detected by the temperature and humidity sensor 50 (illustrated in FIG. 2). Specifically, the controller 60 compares the detected absolute humidity with the threshold absolute humidity M when the swing arm 100 switches the gear combination. When the detected absolute humidity is greater than the threshold absolute humidity M, the gear combination illustrated in FIG. 12C is selected to increase the speed of driving force transmitted to the lubricant supply roller 15*a*. By contrast, when the detected absolute humidity is equal to or smaller than the threshold absolute humidity M, the gear combination illustrated in FIG. 12B is selected to decrease the speed of driving force transmitted to the lubricant supply roller 15*a*.

Such a control operation is executed because, when the ambient absolute humidity is greater than the threshold absolute humidity M, the apparatus in a relatively hot and humid environment, and the amount of lubricant supplied is likely to decrease. By contrast, when the ambient absolute humidity is lower than the threshold absolute humidity M, the apparatus in a relatively cold and dry environment, and the amount of lubricant supplied is likely to increase. This control operation inhibits excess and shortage of the amount of lubricant supplied to the photoconductor drum 11 while reliably alleviating inconveniences such as the occurrence of uneven image density caused by resonance.

As described above, the lubricant supply device 15 according to Embodiment 4 includes the gear combination changer (e.g., the swingable relay gear 82 supported by the swing arm 100) to switch the gear combination to transmit the driving force from the driving motor 45 (serving as the driver as well as the rotation speed changer) to the lubricant supply roller 15*a*, thereby changing the eigenfrequency in driving the lubricant supply roller 15*a*. In the state in which the gear train is in the reference combination and the target speed Ra of the lubricant supply roller 15*a* is consistent with the predetermined avoided speed X, the controller 60 controls the gear combination changer to switch the gear combination from the reference combination to the alternative combination.

With this configuration, even when the rotation speed of the lubricant supply roller 15*a* is changed, the photoconductor drum 11 is prevented from vibrating significantly, and uneven image density is inhibited.

It is to be noted that, in the above-described embodiments, the lubricant supply device 15 is united together with the photoconductor drum 11, the charging roller 12, the developing device 13, and the cleaning device 14 as the process cartridge 10 to make the image forming unit compact and to facilitate maintenance work.

Alternatively, the components of the image forming unit can be configured to be independently installed in the apparatus body so as to be replaced separately. In such a configuration, effects similar to the above-described effects can be attained.

It is to be noted that the term "process cartridge" used in this disclosure means an integrated unit that is removably installable in the image forming apparatus and includes an image bearer and at least one of a charging device to charge the image bearer, a developing device to develop a latent image on the image bearer, and a cleaning device to clean the image bearer.

Additionally, although the description above concerns the image forming apparatus including the two-component developing device 13 using two-component developer, the features of the above-described embodiments can adapt to image forming apparatuses including one-component developing devices using one-component developer.

It is to be noted that, although the description above concerns the lubricant supply device 15 to lubricate the photoconductor drum 11, alternatively, the features of the above-described embodiments can adapt to an image forming apparatuses including a lubricant supply device to lubricate a photoconductor belt serving as an image bearer. Alternatively, the features of the above-described embodiments can adapt to a lubricant supply device to lubricate the intermediate transfer belt 17 serving as an image bearer.

Although the lubricant supply roller 15*a* includes the elastic foam layer overlying the metal core in the above-described embodiments, alternatively, as the lubricant supply roller 15*a*, a brush roller including straight or looped bristles winding around the outer circumference of the metal core can be used instead. As the bristles, resin fibers made of, for example, polyester, nylon, rayon, acrylic resin, vinylon, or vinyl chloride can be used, and conductive fibers to which carbon or the like is mixed to exhibit conductivity can be used as required. For example, the bristles have a bristle length if about 0.2 mm to 20 mm and a bristle density of about 20000 F/in$^2$ to 100000 F/in$^2$.

In such configurations, effects similar to those described above are attained.

The steps in the above-described flowchart may be executed in an order different from that in the flowchart.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

It is to be noted that it is clear that the present disclosure is not limited to the above-described embodiments and modifications to and variations of the above-described teachings are possible within the technical principles of the present disclosure. Additionally, the number, position, and shape of the above-described components are not limited to the above-described embodiments but can be changed suitably.

What is claimed is:

1. An image forming apparatus comprising:

an image bearer to bear a toner image;

a lubricant supply roller to supply lubricant to a surface of the image bearer;

a rotation speed changer to change a rotation speed of the lubricant supply roller; and a controller to control the rotation speed changer to change the rotation speed of the lubricant supply roller to a target speed based on a predetermined condition, the controller to control the rotation speed changer to avoid a predetermined speed range.

2. The image forming apparatus according to claim 1, further comprising an environment detector to detect an ambient absolute humidity, wherein, in a case where the target speed of the lubricant supply roller is consistent with the at least one predetermined speed, the controller compares the ambient absolute humidity detected by the environment detector with a threshold absolute humidity, wherein, when the ambient absolute humidity detected by the environment detector is greater than the threshold absolute humidity, the controller increases the target speed either by a predetermined amount or at a predetermined rate to deviate from the at least one predetermined speed, and wherein, when the ambient absolute humidity detected by the environment detector is equal to or smaller than the threshold absolute humidity, the controller decreases the target speed either by the predetermined amount or at the predetermined rate to deviate from the at least one predetermined speed.

3. The image forming apparatus according to claim 1, further comprising a torque detector to detect a driving torque of the lubricant supply roller being rotating, wherein the controller increases a degree of change of the target speed of the lubricant supply roller when the driving torque detected by the torque detector is greater than a predetermined torque.

4. The image forming apparatus according to claim 1, wherein the predetermined speed range includes a plurality of predetermined speeds.

5. The image forming apparatus according to claim 4, wherein the plurality of predetermined speeds are consecutive values in the predetermined speed range.

6. The image forming apparatus according to claim 1, further comprising a counter to count one of a total travel distance and a total driving time of one of the image bearer and the lubricant supply roller, wherein the controller increments the target speed of the lubricant supply roller either consecutively or stepwise as a count value obtained from the counter increases.

7. The image forming apparatus according to claim 1, further comprising an environment detector to detect an ambient absolute humidity, wherein the controller increments the target speed of the lubricant supply roller either consecutively or stepwise as the ambient absolute humidity detected by the environment detector increases.

8. An image forming apparatus comprising:

an image bearer to bear a toner image;

a lubricant supply roller to supply lubricant to a surface of the image bearer;

a rotation speed changer to change a rotation speed of the lubricant supply roller;

a train of gears to transmit a driving force to the lubricant supply roller;

a gear combination changer to switch the train of gears from a reference combination to an alternative combination to change an eigenfrequency in driving the lubricant supply roller; and a controller to cause the rotation speed changer to change the rotation speed of the lubricant supply roller to a target speed based on a predetermined condition, the controller to cause the gear combination changer to switch the reference combination to the alternative combination in a case where the train of gears is in the reference combination and the target speed of the lubricant supply roller is consistent with at least one predetermined speed to be avoided.

9. The image forming apparatus according to claim 8, wherein the rotation speed changer is a variable-speed motor to drive the lubricant supply roller.

10. The image forming apparatus according to claim 8, further comprising a torque detector to detect a driving torque of the lubricant supply roller being rotating, wherein the controller changes the at least one predetermined speed in accordance with the driving torque detected by the torque detector.

11. The image forming apparatus according to claim 8, wherein the train of gears is configured to change a speed of the driving force transmitted to the lubricant supply roller between the reference combination and the alternative combination.

12. The image forming apparatus according to claim 11, further comprising an environment detector to detect an ambient absolute humidity, wherein the alternative combination includes:

a first alternative combination to increase the speed of the driving force transmitted to the lubricant supply roller, and a second alternative combination to decrease the speed of the driving force transmitted to the lubricant supply roller, wherein, in a case where the ambient absolute humidity detected by the environment detector is greater than a threshold absolute humidity when the gear combination changer switches the train of gears from the reference combination, the controller causes the gear combination changer to switch the reference combination to the first alternative combination, and wherein, in a case where the ambient absolute humidity detected by the environment detector is equal to or smaller than the threshold absolute humidity when the gear combination changer switches the train of gears from the reference combination, the controller causes the gear combination changer to switch the reference combination to the second alternative combination.

13. The image forming apparatus according to claim 8, wherein the train of gears includes:

a driving gear disposed on a motor shaft of the driving motor;

a driven gear disposed on a rotation shaft of the lubricant supply roller; and a plurality of relay gears disposed between the driving gear and the driven gear to relay a driving force from the driving gear to the driven gear, wherein the gear combination changer includes a swingable gear to swing to change a combination of the plurality of relay gears, and wherein the driving motor is rotatable in a normal direction and a reverse direction to keep a direction of rotation of the lubricant supply roller identical regardless of the combination of the plurality of relay gears switched by the gear combination changer.

14. The image forming apparatus according to claim 8, wherein the at least one predetermined speed includes a plurality of predetermined speeds.

15. The image forming apparatus according to claim 14, wherein the plurality of predetermined speeds are consecutive values in a predetermined speed range.

16. The image forming apparatus according to claim 8, further comprising a counter to count one of a total travel distance and a total driving time of one of the image bearer and the lubricant supply roller, wherein the controller increments the target speed of the lubricant supply roller either consecutively or stepwise as a count value obtained from the counter increases.

17. The image forming apparatus according to claim 8, further comprising an environment detector to detect an ambient absolute humidity, wherein the controller regularly increments the target speed of the lubricant supply roller as the ambient absolute humidity detected by the environment detector increases.

18. An image forming apparatus comprising:

an image bearer to bear a toner image;

a lubricant supply roller to supply lubricant to a surface of the image bearer;

a rotation speed changer to change a rotation speed of the lubricant supply roller; and a controller to control the rotation speed changer to regularly change the rotation speed of the lubricant supply roller to a target speed based on a predetermined condition, the controller to irregularly change the target speed of the lubricant supply roller in a predetermined range, the image forming apparatus further comprising an environment detector to detect an ambient absolute humidity, wherein the controller increments the target speed of the lubricant supply roller either consecutively or stepwise as the ambient absolute humidity detected by the environment detector increases.

19. The image forming apparatus according to claim 18, further comprising a counter to count one of a total travel distance and a total driving time of one of the image bearer and the lubricant supply roller, wherein the controller increments the target speed of the lubricant supply roller either consecutively or stepwise as a count value obtained from the counter increases.

* * * * *